US009071014B2

(12) United States Patent
Akaike et al.

(10) Patent No.: US 9,071,014 B2
(45) Date of Patent: Jun. 30, 2015

(54) CONNECTOR

(71) Applicants: TOYOTA BOSHOKU KABUSHIKI KAISHA, Kariya-shi, Aichi-ken (JP); HOSIDEN CORPORATION, Yao-shi, Osaka (JP)

(72) Inventors: Fumitoshi Akaike, Miyoshi (JP); Atsushi Ishii, Nagoya (JP); Yuuki Kawabata, Toyota (JP); Shinichi Masamoto, Nagoya (JP); Takashi Shimizu, Yao (JP); Akihiro Tanaka, Yao (JP)

(73) Assignees: TOYOTA BOSHOKU KABUSHIKI KAISHA, Kariya-shi (JP); HOSIDEN CORPORATION, Yao-Shi (JP)

( * ) Notice: Subject to any disclaimer, the term of this patent is extended or adjusted under 35 U.S.C. 154(b) by 111 days.

(21) Appl. No.: 13/732,592

(22) Filed: Jan. 2, 2013

(65) Prior Publication Data

US 2013/0189870 A1 Jul. 25, 2013

(30) Foreign Application Priority Data

Jan. 6, 2012 (JP) ..... 2012-001535
May 21, 2012 (JP) ..... 2012-115307

(51) Int. Cl.
*H01R 13/62* (2006.01)
*H01R 13/627* (2006.01)
*H01R 4/06* (2006.01)
*H01R 11/22* (2006.01)

(52) U.S. Cl.
CPC ..... *H01R 13/627* (2013.01); *H01R 4/06* (2013.01); *H01R 11/22* (2013.01)

(58) Field of Classification Search
USPC ..... 439/836, 729, 909, 345
See application file for complete search history.

(56) References Cited

U.S. PATENT DOCUMENTS

| | | | | | |
|---|---|---|---|---|---|
| 4,061,408 | A | * | 12/1977 | Bast et al. | 439/263 |
| 4,555,155 | A | * | 11/1985 | Drake | 439/592 |
| 5,137,475 | A | * | 8/1992 | Olms | 439/725 |
| 5,454,739 | A | * | 10/1995 | Strand | 439/729 |
| 5,944,562 | A | * | 8/1999 | Christensson | 439/729 |
| 6,062,915 | A | * | 5/2000 | Costello et al. | 439/729 |
| 6,357,089 | B1 | * | 3/2002 | Koguchi et al. | 24/536 |
| 2012/0208389 | A1 | * | 8/2012 | Nakatsuji et al. | 439/345 |

FOREIGN PATENT DOCUMENTS

| | | | |
|---|---|---|---|
| JP | S63-91989 | | 4/1988 |
| JP | H5-87819 | | 11/1993 |
| JP | 2000-28742 | | 1/2000 |
| JP | 2001-291536 | A1 | 10/2001 |
| JP | 2008-135222 | A1 | 6/2008 |
| JP | 2009-105027 | A1 | 5/2009 |

* cited by examiner

*Primary Examiner* — Alexander Gilman
(74) *Attorney, Agent, or Firm* — Kratz, Quintos & Hanson, LLP

(57) ABSTRACT

A connector of the invention includes first and second conducting parts and a coupling part. The coupling part couples ends of the first and second conducting parts to allow the first and second conducting parts to turn from a closed position, in which the first and second conducting parts sandwich therebetween a conductor having flexibility, to an open position, in which the first and second conducting parts release the conductor. At least one of the first and second conducting parts includes a locking projection. The locking projection is configured to swing in accordance with the turning of the one of the conducting parts and pass through the conductor. The locking projection is of a curved form conforming to a swing track of the locking projection.

28 Claims, 19 Drawing Sheets

CONNECTOR

The present application claims priority under 35 U.S.C. §119 of Japanese Patent Applications No. 2012-1535 filed on Jan. 6, 2012 and No. 2012-115307 filed on May 21, 2012, the disclosure of which is expressly incorporated by reference herein in its entity.

BACKGROUND OF THE INVENTION

1. Technical Field

The invention relates to connectors connectable to flexible electrical conductors such as electrically conductive cloths.

2. Background Art

Japanese Patent Application Laid-Open (JP-A) Nos. 2001-291536 and 2000-28742 each disclose a conventional connection terminal connectable to an electrically conductive cloth. These connection terminals each have hooks, contacts, and cables. The hooks can be locked in holes provided in the conductive cloth. The hooks are provided with the contacts, which are electrically connectable with the conductive cloth. The cables are connected to the contacts.

SUMMARY OF INVENTION

In each of the above connection terminals, as it is required to make holes in the conductive cloth, it is difficult to change the connecting positions of the connection terminals with respect to the conductive cloth. In addition, making holes in the conductive cloth may damage the electrodes in the conductive cloth. Consequently, the conventional connection terminals have low connection stability with respect to the conductive cloth.

In view of the above circumstances, the invention provides a connector that is easy to change its connecting position with respect to an electrical conductor and has improved connecting stability with respect to the electrical conductor.

A first connector according to an aspect of the invention includes first and second conducting parts and a coupling part. The coupling part couples ends of the first and second conducting parts to allow the first and second conducting parts to turn from a closed position, in which the first and second conducting parts sandwich therebetween a conductor having flexibility, to an open position, in which the first and second conducting parts release the conductor. At least one of the first and second conducting parts includes a locking projection. The locking projection is configured to swing in accordance with the turning of the one of the conducting parts and pass through the conductor. The locking projection is of a curved form conforming to a swing track of the locking projection.

In the first connector in this aspect, the first and second conducting parts are connected to the conductor by sandwiching the conductor therebetween to make the locking projection pass through the conductor. It is therefore easy to change the connecting positions of the first and second conducting parts with respect to the conductor. In addition, as the locking projection passes through the conductor, there is no need to make a large hole for attaching a hook in the conductor as in the conventional art. Therefore, there is no damaging of an electrode in the conductor due to hole-making, thereby improving the connection stability of the connector with respect to the conductor. Further, the first connector has improved tension strength with respect to the conductor because the locking projection passes through the conductor. Further, the locking projection is of a curved form conforming to its swing tracks. It is therefore possible to reduce load on the conductor when the locking projection sticks into the conductor.

The first connector may further include first and second bodies with insulation properties. The first body may be fixed to the first conducting part and cover the first conducting part. The second body may be fixed to the second conducting part and cover the second conducting part. In the first connector according to this aspect, the first conducting part covered by the first body and the second conducting part covered by the second body ensure insulation between the first and second conducting parts and the periphery thereof. It is therefore possible to reduce the risk of short circuit or the like in the first and second conducting parts.

A second connector of the invention includes first and second conducting parts, first and second bodies, and a coupling part. The first body is fixed to the first conducting part. The second body is fixed to the second conducting part. The coupling part couples ends of the first and second bodies to allow the first and second conducting parts to turn from a closed position, in which the first and second conducting parts sandwich therebetween a conductor having flexibility, to an open position, in which the first and second conducting parts release the conductor. At least one of the first and second conducting parts includes a locking projection. The locking projection is configured to swing in accordance with the turning of the one of the conducting parts and pass through the conductor. The locking projection is of a curved form conforming to a swing track of the locking projection.

In the second connector in this aspect, the first and second conducting parts are connected to the conductor by sandwiching the conductor therebetween to make the locking projection pass through the conductor. It is therefore easy to change the connecting positions of the first and second conducting parts with respect to the conductor. In addition, as the locking projection passes through the conductor, there is no need to make a large hole for attaching a hook in the conductor as in the conventional art. Therefore, there is no damaging of an electrode in the conductor due to hole-making, thereby improving the connection stability of the connector with respect to the conductor. Further, the second connector has improved tension strength with respect to the conductor because the locking projection passes through the conductor. Further, the locking projection is of a curved form conforming to its swing tracks. It is therefore possible to reduce load on the conductor when the locking projection sticks into the conductor.

At least the other one of the first and second conducting parts may include a locking hole or recess to receive the locking projection. In the first and second connectors in this aspect, as the locking projection is received in the locking hole or recess, the first and second connectors have further improved tension strength with respect to the conductor.

At least one of the first and second conducting parts may include a contacting portion configured to resiliently contact the conductor as sandwiched by the first and second conducting parts. In the first and second connectors in this aspect, the contacting portion resiliently contacts the conductor as sandwiched by the first and second conducting parts. Therefore, the first and second conducting parts have improved retaining force and stable contact resistance values with respect to the conductor. Further, the spring constant of the contacting portion can be changed by changing the shape of the contacting portion. Therefore, the first and second connectors under vibration or shock are less likely to produce resonance with the contacting portion.

The one of the conducting parts may be made of an electrically conductive metal plate. The contacting portion may be a resilient piece formed by cutting and raising a portion of the metal plate. As the contacting portion is a resilient piece formed by cutting and raising a portion of the metal plate, the first and second connectors in this aspect can be manufactured with a reduced number of constituents and with reduced costs.

One of the first and second bodies may include an abutment to create a predetermined clearance between the first and second conducting parts by abutting the other one of the first and second bodies with the first and second conducting parts sandwiching the conductor therebetween. In the first and second connectors in this aspect, when the first and second conducting parts sandwich the conductor therebetween, the abutment abuts the other one of the first and second bodies and thereby creates the predetermined clearance between the first and second conducting parts. Therefore, even when an external force is applied to the first and second connectors, the predetermined clearance between the first and second conducting parts can be ensured, ensuring a predetermined connected state between the first and second conducting parts and the conductor.

The first and second connectors may further include a connecting portion connected to at least one of the first and second conducting parts and connectable to a cable. In the first and second connectors in this aspect, the core of the cable is connectable to the connecting portion. It is therefore easy to externally connect the first and second connectors.

The first and second connectors may further include a holding portion configured to hold the cable. In the first and second connectors in this aspect, the cable, held by the holding portion, has improved tension strength.

The first and second connectors may further include a cable connecting part. The cable connecting part may be fixed to the coupling part, which may be electrically conductive. The cable connecting part may include the connecting portion. In the first and second connectors in this aspect, the core of the cable is connectable to the connecting portion of the cable connecting part fixed to the coupling part. It is therefore easy to externally connect the first and second connectors.

The first and second connectors may further include a movable part provided in at least one of the first and second conducting parts. The movable part may approach and abut the connecting portion of the cable connecting part when the first and second conducting parts turn from the open position to the closed position. Abutment of the movable part on the connecting portion may cause the connecting portion of the cable connecting part to be sandwiched between the movable part and the coupling part.

In the first and second connectors in this aspect, when the first and second conducting parts turn from the open position to the closed position, the movable part approaches and abuts the connecting portion of the cable connecting part. This causes the connecting portion of the cable connecting part to be sandwiched between the movable part and the coupling part. It is therefore possible to improve the fixing strength of the cable connecting part with respect to the coupling part, thereby making the cable connecting part more resistant to external load.

At least one of the cable connecting part and the coupling part may include a hook. The other of the cable connecting part and the coupling part may include a locking hole or recess engageable with the hook. In the first and second connectors in this aspect, the hook engaged in the locking hole or recess makes the cable connecting part more resistant to external load. In addition, the cable, whose core is connected to the connecting portion of the cable connecting part, has improved tension strength.

At least one of the cable connecting part and the coupling part may include a first stop. The other of the cable connecting part and the coupling part may include a locking hole or recess engageable with the first stop. In the first and second connectors in this aspect, engaging the first stop in the locking hole or recess causes the cable connecting part to be positioned with respect to the coupling part. It is therefore easy to fix the cable connecting part to the coupling part.

The first and second connectors may further include a lock mechanism. The lock mechanism may be configured to lock the first conducting part to the second conducting part with the first and second conducting parts sandwiching the conductor therebetween. The lock mechanism may further include a lock hole or recess and a lock piece. The lock hole or recess may be provided in one of the first and second conducting parts. The lock piece may be provided in the other one of the first and second conducting parts and configured to be received in the lock hole or recess. The cable connecting part may include a second stop to abut the lock piece. In the first and second connectors in this aspect, bringing the second stop into abutment with the locking piece causes the cable connecting part to be positioned with respect to the coupling part. It is therefore easy to fix the cable connecting part to the coupling part.

The coupling part may include first and second guide projections in spaced relation to each other. The first and second guide projections may be configured to receive the cable connecting part therebetween to guide the cable connecting part to a fixing position with respect to the coupling part. In the first and second connectors in this aspect, the first and second guide projections guide the cable connecting part to the fixing position. It is therefore easy to fix the cable connecting part to the coupling part.

The first and second bodies may have a same shape and may be made of an insulating resin. The first and second bodies may each include first and second ends and first and second arms. The first end may be an end in a first direction of the first and second bodies. The second end may be an end on the opposite side of the first end in the first direction. The first arm may be provided at the first end and extend in a second direction perpendicular to the first direction. The second arm may be provided at the second end and extend in the second direction. The second arm may be provided with a recess. The recess in the second arm of the second body may accommodate at least one of the connecting portion, the holding portion, and the cable.

In the first and second connectors in this aspect, the first and second bodies of the same shape and made of an insulating resin can be formed with a same die. It is therefore possible to reduce the costs of the first and second connectors. Further, the recess in the second arm of the second body functions as an accommodating recess to accommodate at least one of the connecting portion, the holding portion, and the cable.

At least one of the first and second conducting parts may include at least one of a projection and a recess contactable with the conductor. In the first and second connectors in this aspect, as at least one of the projection and the recess contacts the conductor, it is possible to increase the contact area with respect to the conductor and thereby stabilize the contact resistance value of the first and second conducting parts with respect to the conductor. Therefore, it is possible to further stabilize the connection of the first and second connectors.

The at least one of the projection and the recess may be of a quadrangular pyramid shape. In the first and second connectors in this aspect, as the at least one of the projection and the recess has increased surface area, it is possible to stabilize the contact resistance value of the first and second conducting parts with respect to the conductor. Therefore, it is possible to stabilize the connection of the first and second connectors.

There may be a plurality of locking projections provided at the center and opposite ends of the first conducting part.

The locking projection may be provided with a barb. In the first and second connectors in this aspect, the barb prevents the locking projection from falling off of the conductor. It is therefore possible to improve the tension strength with respect to the conductor. In addition, the barb may be engaged in a locking hole or recess, in which case the first and second conducting parts have further improved holding force with respect to the conductor. It is therefore possible to reduce the risk of the first and second conducting parts accidentally turning from the closed position to the open position.

At least one of the first and second conducting parts may include a rib or a concave-convex face. In the first and second connectors in this aspect, the rib or the concave-convex face improves the strength of at least one of the first and second conducting parts.

The first and second connectors may further include a lock mechanism. The lock mechanism may be configured to lock the first conducting part to the second conducting part with the first and second conducting parts sandwiching the conductor therebetween. In the first and second connectors in this aspect, the lock mechanism locks the first conducting part to the second conducting part, maintains the first and second conducting parts as sandwiching the conductor therebetween. It is therefore possible to reduce the risk of the first and second conducting parts accidentally turning from the closed position to the open position.

The lock mechanism may include a lock lug and a lock hole or recess. The lock lug may be provided in one of the first and second conducting parts. The lock hole or recess may be provided in the other one of the first and second conducting parts to lock the lock lug therein with the first and second conducting parts sandwiching the conductor therebetween. In the first and second connectors in this aspect, the first and second conducting parts as sandwiching the conductor therebetween can be easily locked simply by locking the lock lug in the locking hole or recess.

The lock mechanism may include a lock hole or recess and a lock piece. The lock hole or recess may be provided in one of the first and second conducting parts. The lock piece may be provided in the other one of the first and second conducting parts and received in the lock hole or recess. The lock piece may be bendable. In the first and second connectors in this aspect, the first and second conducting parts as sandwiching the conductor therebetween can be easily locked simply by inserting the locking piece into the locking hole or recess and bending the locking piece. It is also possible to change the distance between the first and second conducting parts simply by changing the bending position of the lock piece according to the thickness dimension of the conductor.

The lock piece may include a bendable portion and a remaining portion excluding the bendable portion. The bendable portion may have a smaller wall thickness than the remaining portion. In the first and second connectors in this aspect, the locking piece can be easily bent at the bendable portion.

The lock hole or recess may be disposed inward of lengthwise ends of the one of the first and second conducting parts. The lock piece may be disposed inward of lengthwise ends of the other one of the first and second conducting parts. In the first and second connectors in this aspect, the locking hole or recess and the locking piece are disposed inward of the opposite ends of the first and second conducting parts. Therefore, providing the lock mechanism in the first and second connectors will not cause significant upsizing of the outer dimensions of the first and second connectors.

The lock mechanism may include a lock hole and a lock piece. The lock hole may be provided in one of the first and second conducting parts. The lock piece may be provided in the other one of the first and second conducting parts to be inserted into the lock hole. The lock piece may bifurcate or trifurcate into distal portions that are plastically deformable in directions away from each other and engageable with an edge of the lock hole. In the first and second connectors in this aspect, it is easy to lock the first and second conducting parts as sandwiching the conductor therebetween, simply by inserting the lock piece into the lock hole, plastically deforming the distal portions of the lock piece in directions away from each other, and engaging them with the edge of the lock hole. It is also possible to change the distance between the first and second conducting parts simply by changing the height position of the engagement of the distal portions of the lock piece with respect to the lock hole in accordance with the thickness dimension of the conductor.

The lock hole may be disposed inward of lengthwise ends of the one of the first and second conducting parts. The lock piece may be disposed inward of lengthwise ends of the other one of the first and second conducting parts. In this aspect of the invention, the locking hole or recess and the locking piece are disposed inward of the opposite ends of the first and second conducting parts. Therefore, providing the lock mechanism in the first and second connectors will not cause significant upsizing of the outer dimensions of the first and second connectors.

DESCRIPTION OF EMBODIMENTS

Figure 1A:
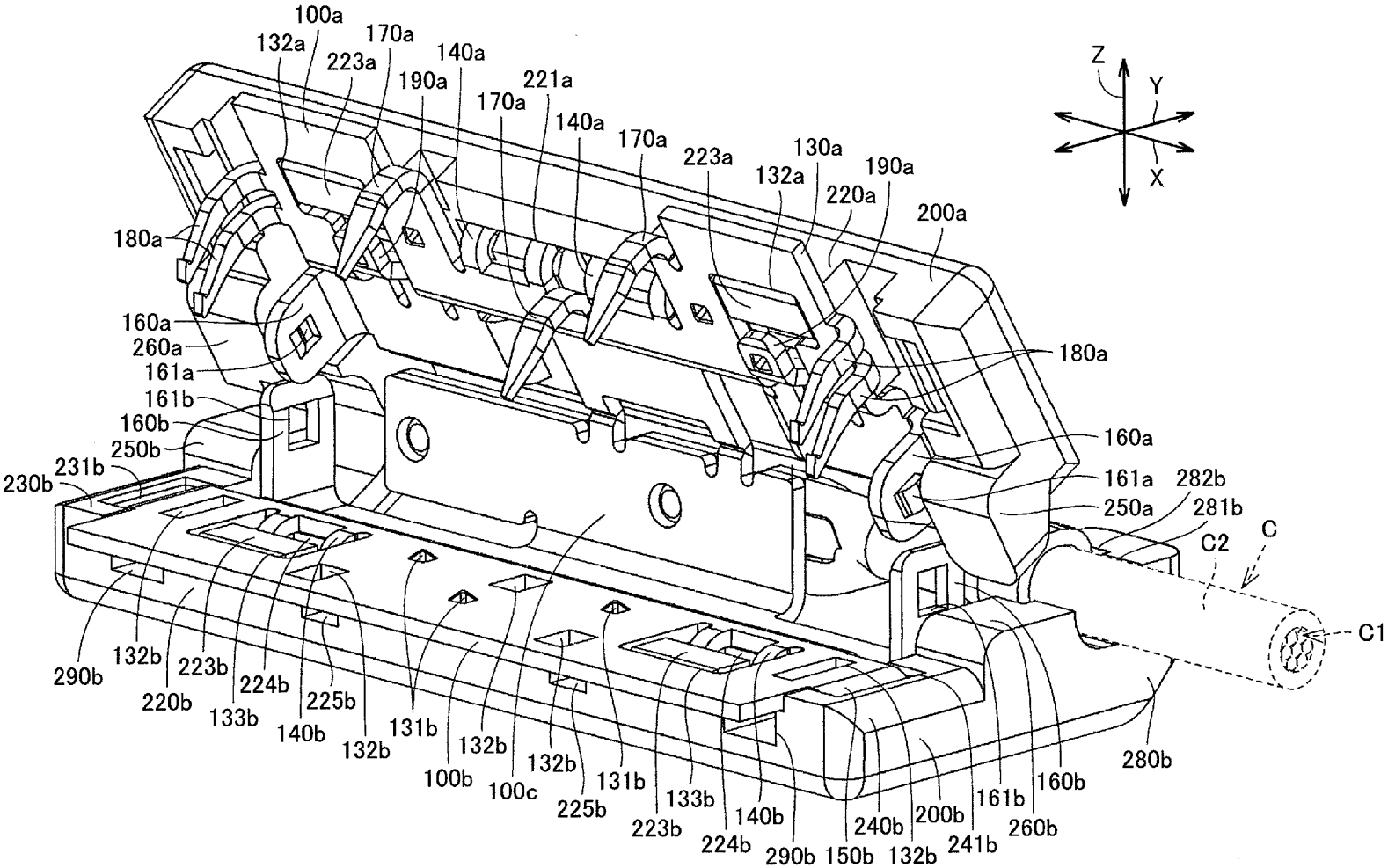
FIG. 1A is a front, top, and right side perspective view of a connector according to Embodiment 1 of the invention, in which a cable is connected to the connector and first and second conducting parts are located in an open position.

Hereinafter, Embodiments 1 and 2 of the invention will be described.

Embodiment 1

First, a connector according to Embodiment 1 of the invention will be described below with reference to FIGS. 1A to 3B. The connector shown in FIGS. 1A and 1B may be used for connection with a flexible conductive cloth (conductor, not shown). The connector includes a first conducting part 100*a*, a second conducting part 100*b*, a coupling part 100*c*, a cable connecting part 100*d*, a first body 200*a*, and a second body 200*b*. These constituents of the connector will be described below in detail. FIGS. 1A to 2D show directions X, Y, and Z, wherein X is the length direction of the connector, Y is the front-rear direction of the connector, and Z is the height direction of the connector. The Y direction is perpendicular to the X direction, and the Z direction is perpendicular to the X and Y directions.

As shown in FIGS. 2A to 2D, the first conducting part 100*a*, the second conducting part 100*b*, and the coupling part 100*c* are made of a plate of electrically conductive metal. The second conducting part 100*b* includes a first plate 110*b*, a second plate 120*b*, a third plate 130*b*, a pair of first locking pieces 140*b*, a pair of second locking pieces 150*b*, and a pair of third locking pieces 160*b* (constituent of a lock mechanism).

The first plate 110*b* is a rectangular plate extending in the X direction and to one side in the Y direction (to the front side). The third locking pieces 160*b* are joined to opposite ends in the X direction of the first plate 110*b*. The third locking pieces 160*b* are plates bent upward (to one side in the Z direction). The third locking pieces 160*b* are each provided with a rectangular lock hole 161*b*.

The second plate 120*b* is a rectangular plate joined to the first plate 110*b* and bent substantially at a right angle to the first plate 110*b* to extend toward the first conducting part 100*a*. The third plate 130*b* is a rectangular plate joined to the second plate 120*b* and extends in the X direction and to one side in the Y direction (to the front side). The third plate 130*b* is bent substantially at a right angle to the second plate 120*b* so that the first plate 110*b* and the third plate 130*b* do not face each other. The third plate 130*b* is provided at its center with a plurality of projections 131*b* and a plurality of locking holes 132*b*. The projections 131*b* are of quadrangular pyramid shape projecting in the upward direction (to one side in the Z direction). The locking holes 132*b* are rectangular holes passing through the third plate 130*b* in the Z direction, and they are arranged in the positions corresponding to locking projections 170*a* and 180*a* (to be described) of the first conducting part 100*a*. The locking holes 132*b* correspond to the "locking holes" defined in the claims.

The third plate 130*b* is provided at its opposite ends in the X direction with the first locking pieces 140*b*. The first locking pieces 140*b* are formed by cutting and raising portions of the opposite ends downward (to the other side in the Z direction). The first locking pieces 140*b* are provided with rectangular locking holes. Cutting and raising the first locking pieces 140*b* leaves holes 133*b* at opposite ends in the X direction of the third plate 130*b*. The second locking pieces 150*b* are joined to respective opposite ends in the X direction of the third plate 130*b*. The second locking pieces 150*b* are plates bent downward (to the other side in the Z direction).

The first conducting part 100*a* includes a first plate 110*a*, a second plate 120*a*, a third plate 130*a*, a pair of first locking pieces 140*a*, a pair of second locking pieces 150*a*, a pair of third locking pieces 160*a* (constituent of the lock mechanism), a plurality of locking projections 170*a*, a plurality of locking projections 180*a*, and contacting portions 190*a*.

The first plate 110*a* is a rectangular plate extending in the X direction and obliquely upward (in a direction between the one side in the Z direction and the one side in the Y direction). The first plate 110*a* is provided at its center with a pair of arms 111*a*. Opposite outer sides of the arms 111*a* of the first plate 110*a* are cut and raised to form the second locking pieces 150*a*. The third locking pieces 160*b* are plates joined to opposite ends in the X direction of the first plate 110*a* bent downward. The third locking pieces 160*b* are provided with lock lugs 161*a*. The lock lugs 161*a* can be locked in the lock holes 161*b* in the second conducting part 100*b*.

The second plate 120*a* is a rectangular plate joined to the first plate 110*a* and bent substantially at a right angle to the first plate 110*a* to extend toward the second conducting part 100*b*. The third plate 130*a* is a plate joined to the second plate 120*a* and extending in the X direction and obliquely upward. The third plate 130*a* is bent substantially at a right angle to the second plate 120*a* so that the first plate 110*a* and the third plate 130*a* do not face each other. The third plates 130*a* and 130*b* are adapted to securely sandwich the conductive cloth therebetween when the first and second conducting parts 100*a* and 100*b* are located in a closed position (to be described).

The central portion of the third plate 130*a* is cut and raised to form the pair of first locking pieces 140*a*, which are spaced apart from each other in the X direction. The first locking pieces 140*a* are each provided with a rectangular locking hole. The locking projections 170*a* are of pointed shape and joined to the third plate 130*a*, more particularly to an area between the first locking pieces 140*a* and areas on either outer side of the first locking pieces 140*a* of the third plate 130*a*. The locking projections 170*a* can swing in accordance with the turning of the first conducting part 100*a*. As shown in FIG. 2D, the locking projections 170*a* are bent substantially at right angles to the third plate 130*a*, and they are of curved forms conforming to their swing tracks. The swing tracks of the locking projections 170*a* are indicated in dot-dash lines in FIG. 2D.

Projections 131*a* are provided at the feet of the locking projections 170*a* at opposite ends of the third plate 130*a*. The projections 131*a* are of quadrangular pyramid shape projecting in the same direction as the locking projections 170*a*. Locking holes 132*a* are provided on the respective outer sides of the projections 131*a* of the third plate 130*a*. The locking holes 132*a* pass through the third plate 130*a*. The locking projections 180*a* are of pointed shape and joined to opposite ends in the X direction of the third plate 130*a*. The locking projections 180*a* can swing in accordance with the turning of the first conducting part 100*a*. As shown in FIG. 2D, the locking projections 180*a* are bent substantially at right angles to the third plate 130*a*, and they are of curved forms conforming to their swing tracks. The swing tracks of the locking projections 180*a* are indicated in dot-dash lines in FIG. 2D. The locking projections 180*a* are each provided at its end with a barb 181*a*. The locking projections 170*a* and 180*a* are arranged at positions corresponding to the locking holes 132*b* in the second conducting part 100*b* (that is, at the center and at the opposite ends of the first conducting part 100*a*). When the first and second conducting parts 100*a* and 100*b* are located in the closed position, the locking projections 170*a* and 180*a* pass through the conductive cloth and are received in the locking holes 132*b*. The barbs 181*a* can be locked in the locking holes 132*b*.

The contacting portions 190*a* are resilient pieces formed by cutting and depressing portions at opposite ends in the X direction of the first plate 110*a*, the second plate 120*a*, and the third plate 130*a*. The contacting portions 190*a* are bent stepwise such that the lower faces of the distal ends of the contacting portions 190*a* (the faces facing the second conducting part) are located closer to the second conducting part 100*b* than the lower face of the third plate 130*a* (the face facing the second conducting part). Therefore, the contacting portions 190*a* resiliently contact the conductive cloth sandwiched between the first and second conducting parts 100*a* and 100*b* when the first and second conducting parts 100*a* and 100*b* are located in the closed position. The contacting portions 190*a* are each provided at its distal end with a projection 191*a*. The projections 191*a* are of quadrangular pyramid shape projecting in the same direction as the locking projections 170*a*.

The coupling part 100*c* is a rectangular plate to couple the ends of the first and second conducting parts 100*a* and 100*b* such that the first and second conducting parts 100*a* and 100*b* are turnable from the closed position to an open position. The coupling part 100*c* is joined to the rear end (the end on the other side in the Y direction, i.e. the other end in the Y direction) of the first plate 110*b* of the second conducting part 100*b*, and it is bent substantially at a right angle to the first plate 110*b*. The coupling part 100*c* is provided with a pair of arms 110*c* extending upward (to the one side in the Z direction). The arms 110*c* are coupled to the arms 111*a* of the first conducting part 100*a*. The boundaries between the arms 110*c* and the arms 111*a* are thin-walled. The boundaries serve as pivots on which the first and second conducting parts 100*a* and 100*b* turn (open and close) from the closed position to the open position. The first and second conducting parts 100*a* and 100*b* in the closed position face each other substantially in parallel and may securely sandwich the conductive cloth therebetween. As shown in FIGS. 1A to 2D, the first and second conducting parts 100*a* and 100*b* in the open position are located away from each other, allowing the conductive cloth to be released from therebetween.

Figure 2A:
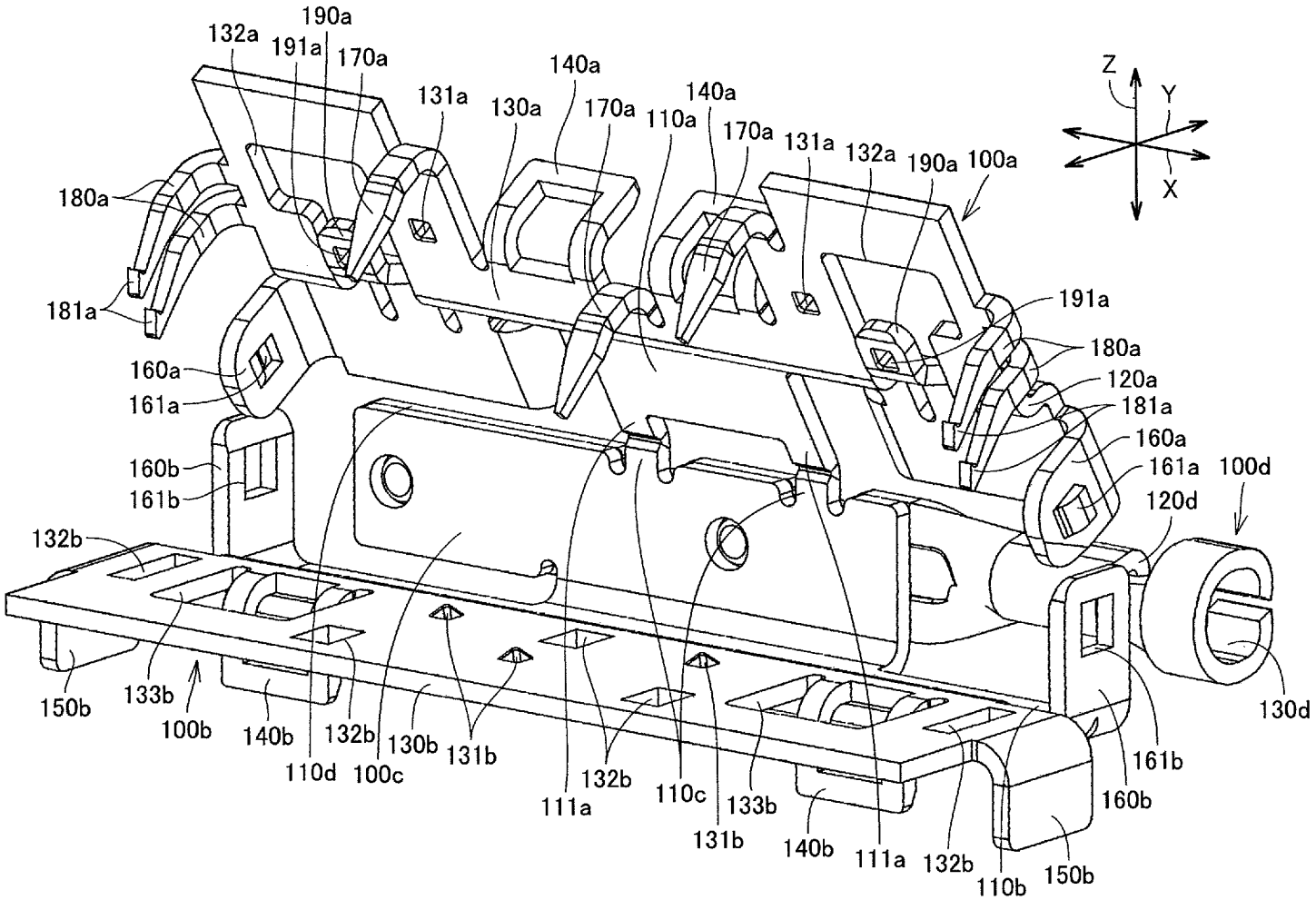
FIG. 2A is a front, top, and right side perspective view of the first and second conducting parts, a coupling part, and the cable connecting part of the connector, in which the first and second conducting parts are located in the open position.
Figure 2B:
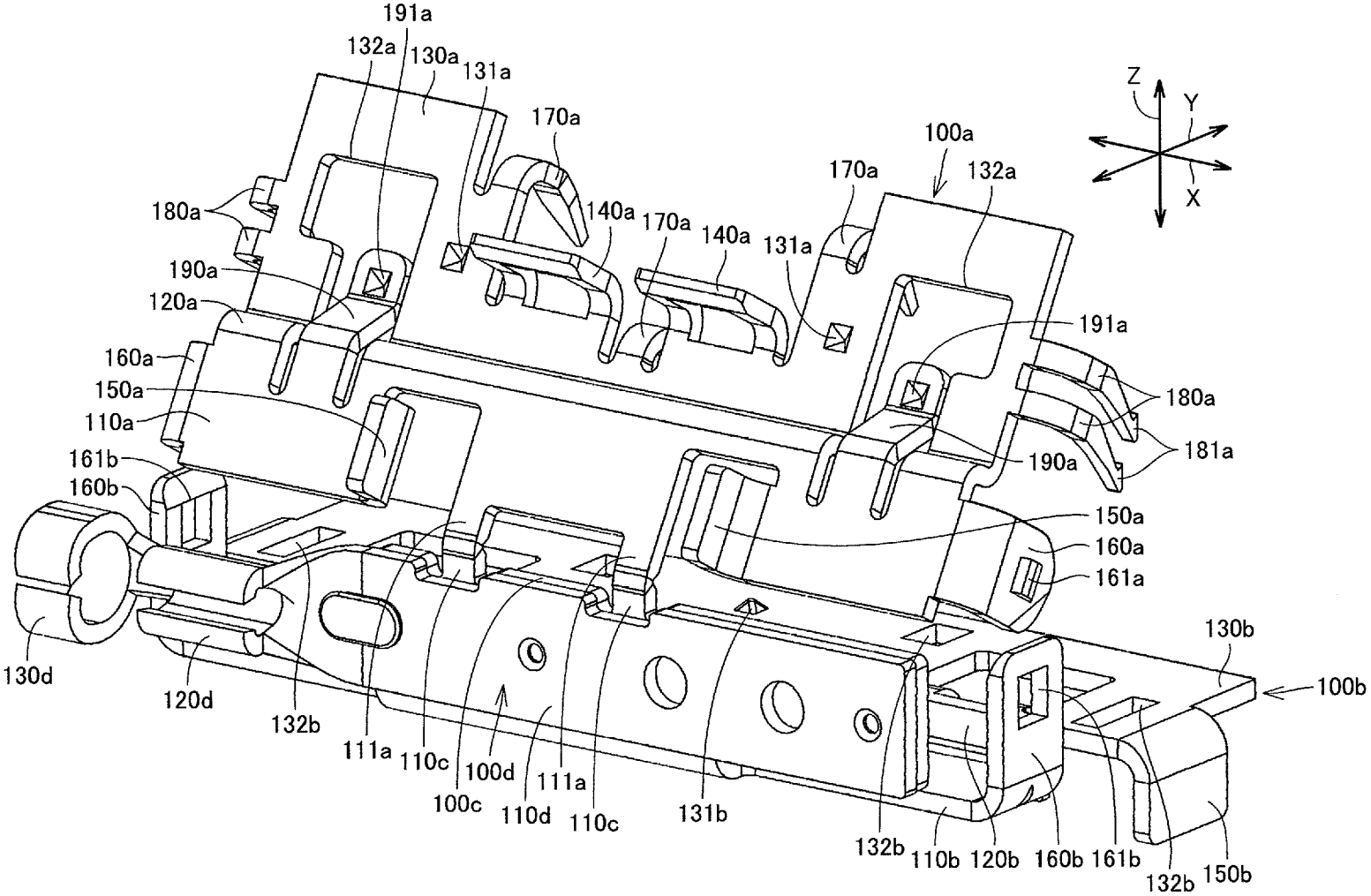
FIG. 2B is a rear, top, and left side perspective view of the first and second conducting parts, the coupling part, and the cable connecting part of the connector, in which the first and second conducting parts are located in the open position.
Figure 2C:
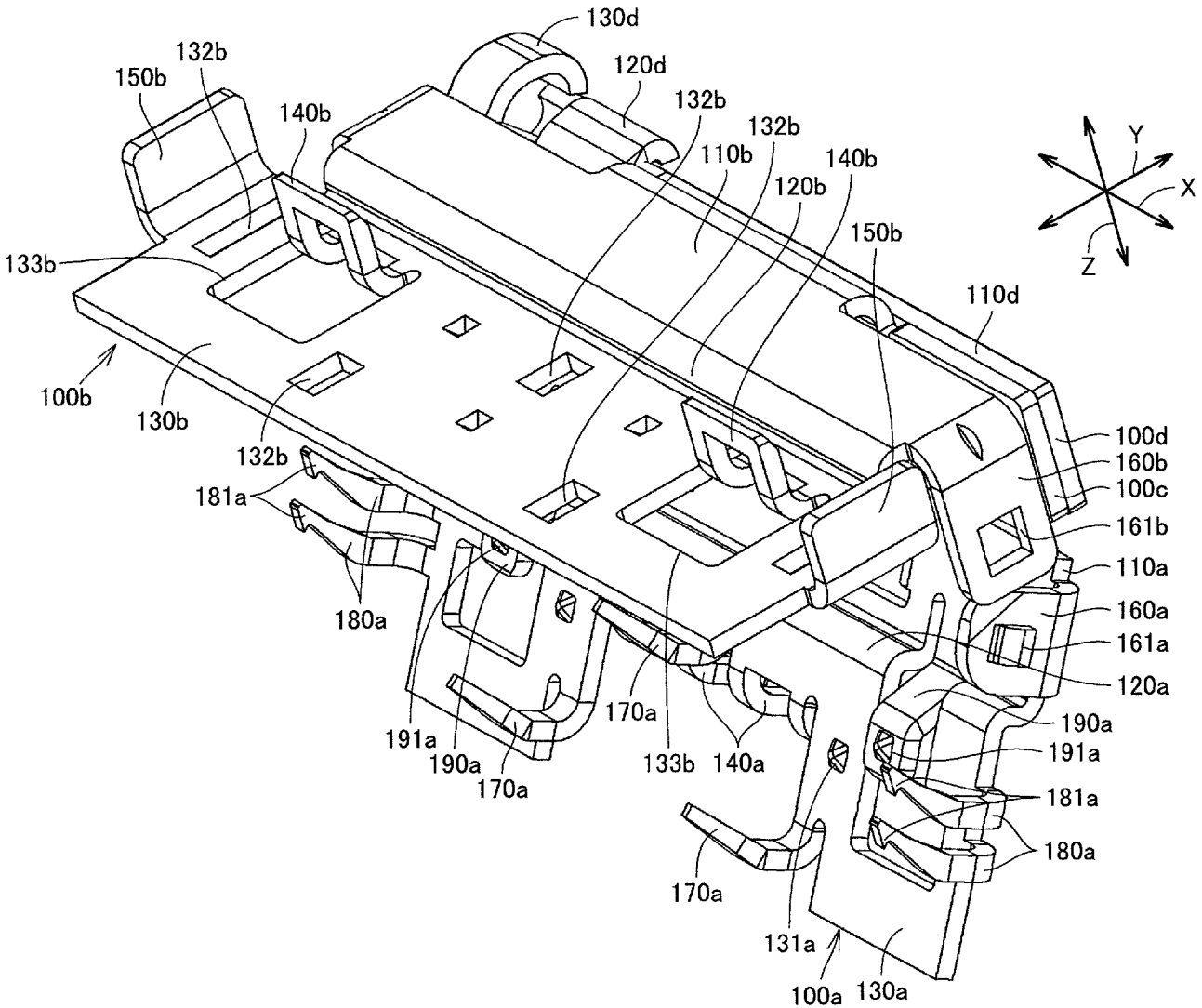
FIG. 2C is a front, bottom, and left side perspective view of the first and second conducting parts, the coupling part, and the cable connecting part of the connector, in which the first and second conducting parts are located in the open position.
Figure 2D:
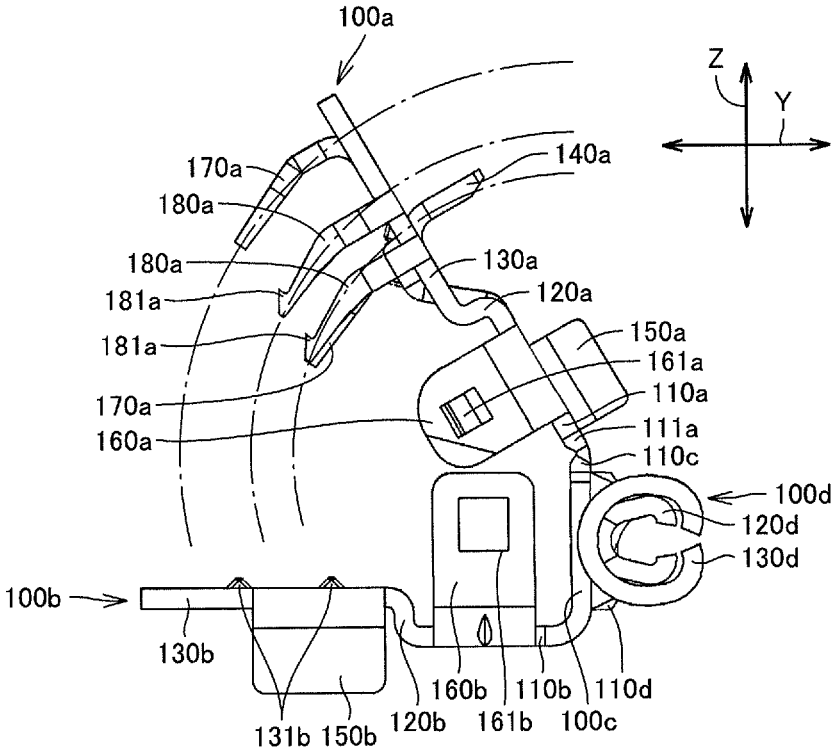
FIG. 2D is a right side view of the first and second conducting parts, the coupling part, and the cable connecting part of the connector, in which the first and second conducting parts are located in the open position.

As shown in FIG. 2B, the cable connecting part 100*d* is a plate of electrically conductive metal. The cable connecting part 100*d* includes a fixed portion 110*d*, a connecting portion 120*d*, and a holding portion 130*d*. The fixed portion 110*d* is a plate of substantially the same shape as the coupling part 100*c*, and it is fixed to the rear face of the coupling part 100*c*. The connecting portion 120*d* is a generally C-shaped plate joined to the fixed portion 110*d*, and it is of inside diameter slightly smaller than the outside diameter of a core C1 of a cable C. The connecting portion 120*d* is adapted to hold the core C1 of the cable C. The holding portion 130*d* is a generally C-shaped plate joined to the connecting portion 120*d*, and it is of inside diameter slightly smaller than the outside diameter of an insulative protective cover C2 that covers the core C1 of the cable C. The holding portion 130*d* is adapted to hold the protective cover C2 of the cable C.

Figure 3A:
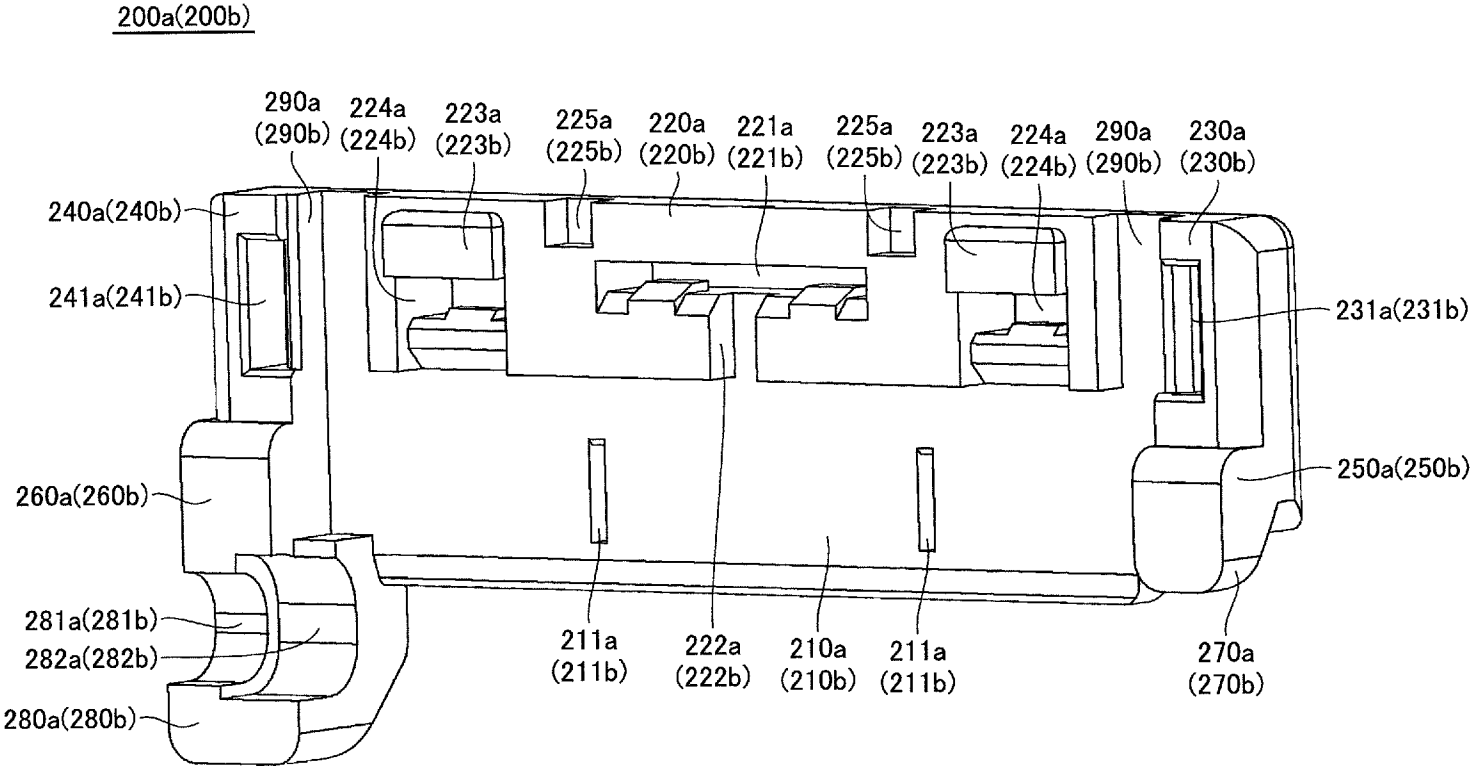
FIG. 3A is a front, top, and right side perspective view of a body of the connector.
Figure 3B:
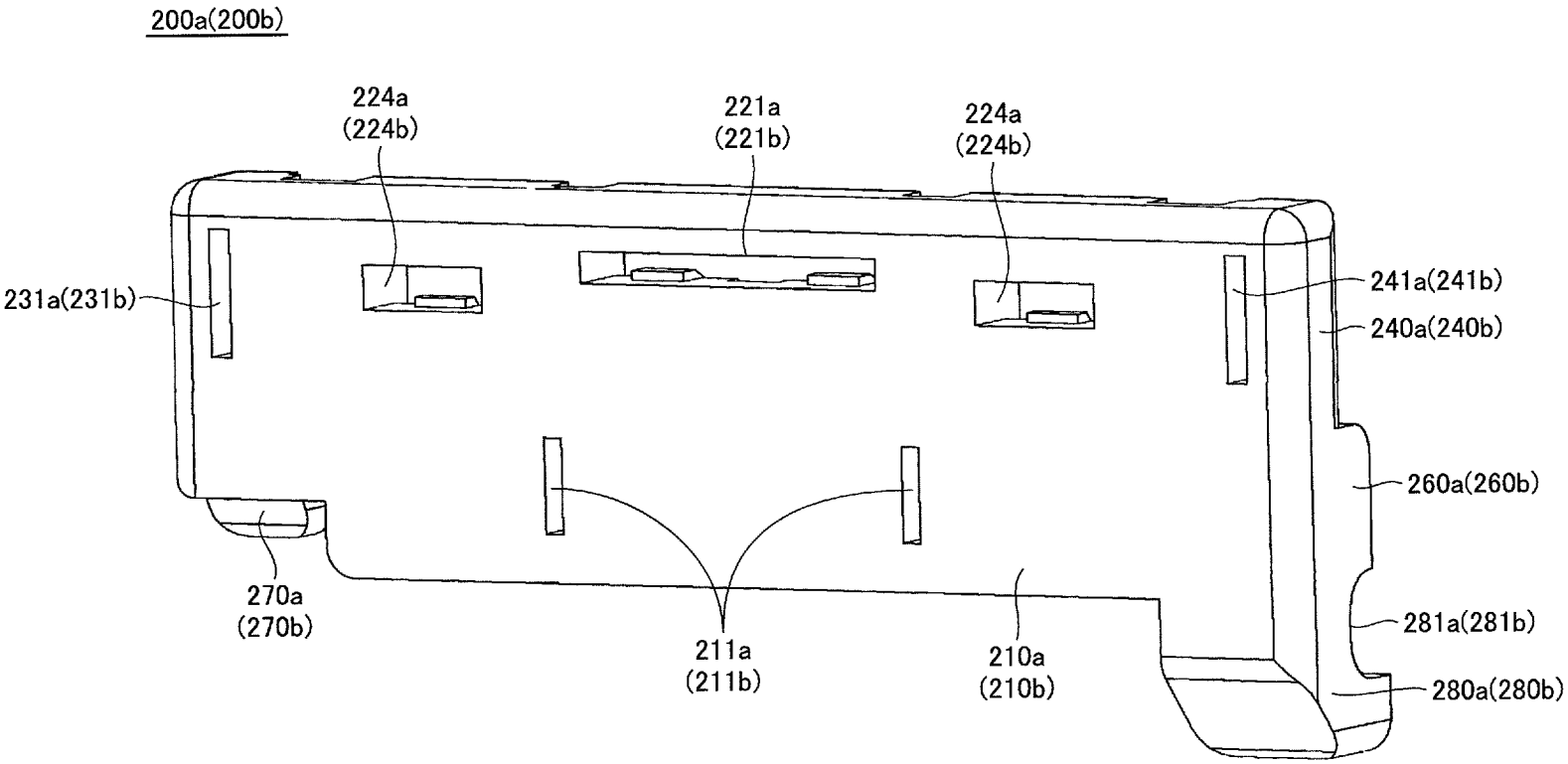
FIG. 3B is a rear, top, and left side perspective view of the body of the connector.

As shown in FIGS. 3A and 3B, the second body 200*b* is a block of an insulating resin. The second body 200*b* has a larger dimension in the X direction than the second conducting part 100*b*. Accordingly, the second body 200*b* as fixed to the second conducting part 100*b* (to be described) covers the second conducting part 100*b* (see FIGS. 1A and 1B). The second body 200*b* can turn in accordance with the turning of the second conducting part 100*b*. The second body 200*b* has a base 210*b*, a stand 220*b*, walls 230*b* and 240*b*, abutments 250*b* and 260*b*, a first arm 270*b*, and a second arm 280*b*.

The base 210*b* is a generally rectangular plate extending in the X direction and to one side in the Y direction (to the front side) and including inner and outer faces. The stand 220*b* is of rectangular parallelepiped and provided at the center of the distal portion (the one end portion in the Y direction) of the inner face of the base 210*b*. The stand 220*b* is provided at its center with a locking hole 221*b*. The locking hole 221*b* is a rectangular hole extending in the X direction. On an inner wall of the locking hole 221*b*, there is provided a pair of lock lugs spaced apart from each other in the X direction. A pair of locking holes 211*b* extends in the Y direction in the central area of the basal portion of the base 210*b* (the other end portion in the Y direction).

In opposite ends in the X direction of the stand 220*b*, there is provided a pair of protrusions 223*b* and a pair of locking holes 224*b*. The protrusions 223*b* are rectangular and project inward of the second body 200*b*. The locking holes 224*b* are rectangular and located under the protrusions 223*b*. The locking holes 224*b* are provided in their inner walls with lock lugs. The walls 230*b* and 240*b* are joined to opposite ends in the X direction of the base 210*b*. The walls 230*b* and 240*b* each have a larger thickness dimension than the base 210*b*, i.e. the walls 230*b* and 240*b* project to the inner face side of the base 210*b*. The walls 230*b* and 240*b* are provided in their distal portions with rectangular locking holes 231*b* and 241*b*, respectively.

The protrusions 223*b* are engaged in the holes 133*b* of the second conducting part 100*b*. The locking holes 224*b* receive the first locking pieces 140*b* of the second conducting part 100*b*, and the lock lugs of the locking holes 224*b* are locked in the locking holes of the first locking piece 140*b*. The locking holes 231*b* and 241*b* fit over the second locking pieces 150*b* of the second conducting part 100*b*. The second body 200*b* is thus fixed to the second conducting part 100*b*. In this fixed state, the third plate 130*b* and the first plate 110*b* of the second conducting part 100*b* abut the stand 220*b* and the basal portion, respectively, of the base 210*b*.

A recess 222*b* is provided under the locking hole 221*b* at the center of the stand 220*b*. The recess 222*b* extends in the direction perpendicular to the length direction of the locking hole 221*b* and communicates with the center of the locking hole 221*b*. The stand 220*b* also has a pair of recesses 225*b*, each between the recess 222*b* and one of the protrusions 223*b*. In addition, clearances 290*b* are created between the walls 230*b* and 240*b* and the stand 220*b*. The recesses 222*b* and 225*b* and the clearance 290*b* are located under the locking holes 132*b* in the second conducting part 100*b*. When the locking holes 132*b* in the second conducting part 100*b* receive the locking projections 170*a* of the first conducting part 100*a*, the locking projections 170*a* at opposite ends are received in the recesses 225*b*, and the locking projection 170*a* at the center is received in the recess 222*b*. When the locking holes 132*b* in the second conducting part 100*b* receive the locking projections 180*a* of the first conducting part 100*a*, the locking projections 180*a* are received in the clearances 290*b*. This arrangement prevents interference between the locking projections 170*a* and the second body 200*b*.

The abutments 250*b* and 260*b* project from the rear ends of the walls 230*b* and 240*b*, respectively. The abutments 250*b* and 260*b* project inward of the second body 200*b*. The first arm 270*b* is joined to the rear end of the abutment 250*b* (that is, a first end in the length direction (first direction) of the second body 200*b*). The first arm 270*b* extends in the width direction (second direction) of the second body 200*b*. The first arm 270*b* has a tapered cross-section getting gradually narrower towards the distal end. The second arm 280*b* is joined to the rear ends of the base 210*b*, the wall 240*b*, and the abutment 260*b* (i.e., a second end in the length direction (the first direction) of the second body 200*b*). The second arm 280*b* extends in the width direction (the second direction) of the second body 200*b*. The second arm 280*b* is provided with first and second recess 281*b* and 282*b*, which are semi-circular and adjacent to each other in the X direction. The first recess 281*b* has a smaller inner shape than the second recess 282*b*. The second recess 282*b* accommodates a part of the holding portion 130*d*. The first recess 281*b* can accommodate a part of the protective cover C2 of cable C. The first recess 281*b* corresponds to the recess in the second arm of the second body defined in the claims.

As shown in FIGS. 3A and 3B, the first body 200*a* is a block of insulating resin and has the same shape as the second body 200*b*. The second body 200*a* has a larger dimension in the X direction than the first conducting part 100*a*. Accordingly, the first body 200*a* as fixed to the first conducting part 100*a* (to be described) covers the first conducting part 100*a* (see FIGS. 1A and 1B). The first body 200*a* can turn in accordance with the turning of the first conducting part 100*a*. The first body 200*a* has a base 210*a*, a stand 220*a*, walls 230*a* and 240*a*, abutments 250*a* and 260*a*, a first arm 270*a*, and a second arm 280*a*. These portions of the first body 200*a* will not be described with regard to overlaps with those of the second body 200*b*.

Locking holes 211*a* in the base 210*a* fittingly receive the second locking pieces 150*a* of the first conducting part 100*a*. Locking hole 221*a* in the stand 220*a* receive the first locking pieces 140*a* of the first conducting part 100*a*, and lock lugs in the locking hole 221*a* are locked in the locking holes in the first locking pieces 140*a*. Protrusions 223*a* of the stand 220*a* are rectangular, project inward of the first body 200*a*, and are fitted in the respective locking holes 132*a* in the first conducting part 100*a*. The first body 200*a* is thus fixed to the first conducting part 100*a*. In this fixed state, the third plate 130*a* of the first conducting part 100*a* abuts the stand 220*a*, and the first plate 110*a* abuts the base end of the base 210*a*.

Recesses 222*a* and 225*a* are located under the locking projections 170*a* of the first conducting part 100*a*. Clearances 290*a* created between the walls 230*a* and 240*a* and the stand 220*a* are located under the locking projections 180*a* of the first conducting part 100*a*.

Figure 1B:
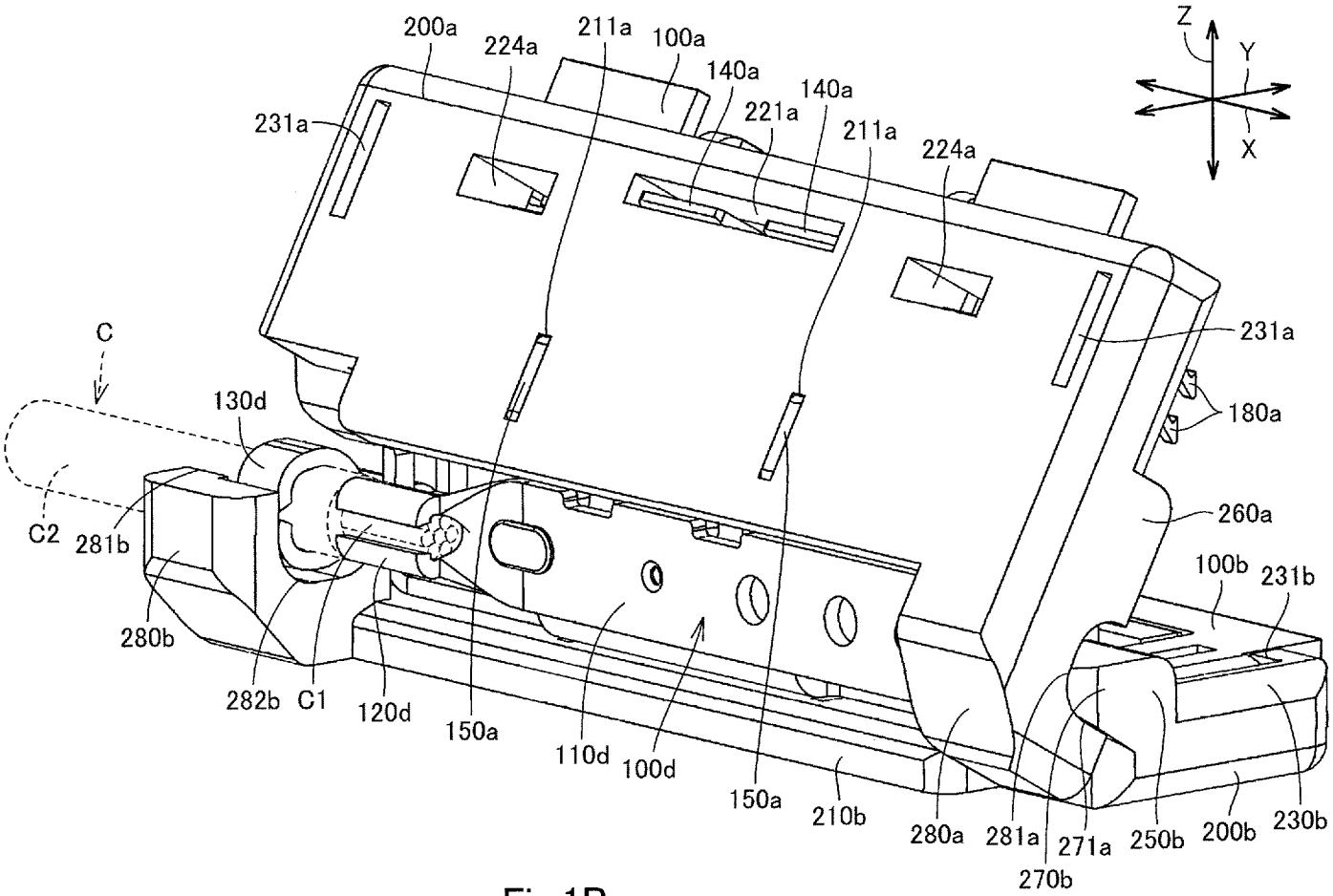
FIG. 1B is a rear, top, and left side perspective view of the connector, in which the cable is connected to the connector and the first and second conducting parts are located in the open position.

When the first and second conducting parts 100*a* and 100*b* are located in the closed position, the abutments 250*a* and 260*a* abut the abutments 250*b* and 260*b*, respectively. This state creates a predetermined clearance between the third plate 130*a* of the first conducting part 100*a* and the third plate 130*b* of the second conducting part 100*b*. The clearance is set to be slightly smaller than the thickness dimension of the conductive cloth. Accordingly, the third plate 130*a* of the first conducting part 100*a* and the third plate 130*b* of the second conducting part 100*b* can securely sandwich the conductive cloth therebetween in a predetermined state in which the first and second conducting parts 100*a* and 100*b* are located in the closed position. On the other hand, when the first and second conducting parts 100*a* and 100*b* are located in the open position, as shown in FIG. 1B, the first arm 270*b* of the second body 200*b* is received in a first recess 281*a* of the first body 200*a*. The first recess 281*a* corresponds to the recess in the second arm of the first body defined in the claims.

Described in detail below are steps to assemble the connector configured as described above and to connect the connector to the connecting cable C. The first step is to prepare the cable connecting part 100*d* formed by pressing an electrically conductive metal plate. The cable connecting part 100*d* now have the connecting portion 120*d* and the holding portion 130*d* in planar form. The next step is to prepare the cable C, in which one end in the length direction of the protective cover C2 is peeled off to expose the core C1 from the protective cover C2. The exposed core C1 and the protective cover C2 are brought closer to the connecting portion 120*d* and the holding portion 130*d*, respectively. The connecting portion 120*d* is then bent generally in a C-shape and fixedly connected to the core C1. Likewise, the holding portion 130*d* is bent generally in a C-shape and fixed to the protective cover C2.

The next step is to prepare the first conducting part 100*a*, the second conducting part 100*b*, and the coupling part 100*c*, which are formed by pressing an electrically conductive metal plate. The coupling part 100*c* is fixed to the fixed portion 110*d* of the cable connecting part 100*d*. The core C1 of cable C is thus electrically connected to the first and second conducting parts 100*a* and 100*b* via the coupling part 100*c*.

The next step is to prepare the first body 200*a* and the second body 200*b*, formed by injection molding insulating resin. The first locking pieces 140*b* of the second conducting part 100*b* are inserted into the locking holes 224*b* in the second body 200*b*, while the second locking pieces 150*b* of the second conducting part 100*b* are inserted into the locking holes 231*b* and 241*b*. The first locking pieces 140*b* are thus locked in the locking hole 224*b*, while the second locking pieces 150*b* are locked in the locking holes 231*b* and 241*b*.

Simultaneously, the third plate 130*b* of the second conducting part 100*b* abuts the stand 220*b* of the second body 200*b*, while the first plate 110*b* of the second conducting part 100*b* abuts the base end of the base 210*b* of the second body 200*b*. The protrusions 223*b* of the second body 200*b* are engaged into the holes 133*b* in the second conducting part 100*b*. The recesses 222*b* and 225*b* and the clearances 290*b* of the second body 200*b* are located under and in communication with the associated locking holes 132*b*. The second recess 282*b* in the second arm 280*b* of the second body 200*b* accommodates a part of the holding portion 130*d* of the cable connecting part 100*d*. The first recess 281*b* accommodates a part of the protective cover C2 of cable C. Consequently, the second body 200*b* is attached to the second conducting part 100*b* to cover the rear side of the second conducting part 100*b*.

On the other hand, the first locking pieces 140*a* of the first conducting part 100*a* are inserted into the locking hole 221*a* in the first body 200*a*, and the second locking pieces 150*a* of the first conducting part 100*a* are inserted into the locking holes 211*a* in the first body 200*a*. The first locking pieces 140*a* are thus locked in the locking hole 221*a*, while the second locking pieces 150*a* fit into the locking holes 211*a*. Simultaneously, the third plate 130*a* of the first conducting part 100*a* abuts the stand 220*a*, the first plate 110*a* of the first conducting part 100*a* abuts the base end of the base 210*a*, and the protrusions 223*a* of the first body 200*a* fit into the locking holes 132*a* in the first conducting part 100*a*. The distal ends of the contacting portions 190*a* are located above the locking holes 224*a* in the first body 200*a*. Consequently, the first body 200*a* is attached to the first conducting part 100*a* to cover the rear side of the first conducting part 100*a*.

Described below are the steps to connect the conductive cloth to the connector assembled as described above. First, the first and second conducting parts 100*a* and 100*b* are brought into the open position. The first body 200*a* and the second body 200*b* are accordingly brought into in the open position. Simultaneously, the first arm 270*b* of the second body 200*b* is inserted into the first recess 281*b* in the first body 200*a*.

Then, the conductive cloth is inserted between the first and second conducting parts 100*a* and 100*b*. The next step is to turn the first and second conducting parts 100*a* and 100*b* and the first and second bodies 200*a* and 200*b* from the open position to the closed position, using the boundaries between the arms 110*c* and the arms 111*a* as pivots. The first and second conducting parts 100*a* and 100*b* are thus brought closer to each other to sandwich the conductive cloth therebetween. Simultaneously, the locking projections 170*a* at opposite ends of the first conducting part 100*a* swing in accordance with the turning of the first conducting part 100*a*, stick into the conductive cloth, and are received into the locking holes 132*b* of the second conducting part 100*b* and then into the recesses 225*b* in the second body 200*b*. The other locking projection 170*a* swings in accordance with the turning of the first conducting part 100*a* and sticks into the conductive cloth, and is received into the locking hole 132*b* in the second conducting part 100*b* and then into the recess 222*b* in the second body 200*b*. The locking projections 180*a* swing in accordance with the turning of the first conducting part 100*a*, stick into the conductive cloth, and are engagingly received into the locking holes 132*b* in the second conducting part 100*b* and then into the clearances 290*b* in the second body 200*b*. The contacting portions 190*a* of the first conducting part 100*a* resiliently press the conductive cloth onto the third plate 130*b* of the second conducting part 100*b*. The projections 191*a* of the contacting portions 190*a* thus abut the conductive cloth. The projections 131*a* of the first conducting part 100*a* and the projections 131*b* of the second conducting part 100*b* also abut the conductive cloth.

In the course of turning the first body 200*a* and the second body 200*b* from the open position to the closed position, the first arm 270*b* of the second body 200*b* goes out of the first recess 281*a* of the first body 200*a*. When the first body 200*a* and the second body 200*b* are located in the closed position, the abutments 250*a* and 260*a* of the first body 200*a* abut the abutments 250*b* and 260*b*, respectively, of the second body 200*b*. Also, the lock lugs 161*a* of the first conducting part 100*a* are locked in the lock holes 161*b* in the second conducting part 100*b*. This locking causes the first and second conducting parts 100*a* and 100*b* to be maintained in the closed position, reducing a risk that the first and second conducting parts 100*a* and 100*b* may accidentally turn from the closed position to the open position.

In the connector as described above, the first and second conducting parts 100*a* and 100*b* are connected to the conductive cloth by sandwiching the conductive cloth therebetween to make the locking projections 170*a* and 180*a* pass through the conductive cloth. It is therefore easy to change the connection positions of the first and second conducting parts 100*a* and 100*b* with respect to the conductive cloth. In addition, as the locking projections 170*a* and 180*a* pass through the conductive cloth, there is no need to make large holes for attaching hooks in the conductive cloth. Therefore, there is no damaging of the electrodes in the conductive cloth due to hole-making, thereby improving the connection stability of the connector with respect to the conductive cloth. Further, the connector has improved tension strength with respect to the conductive cloth because the locking projections 170*a* and 180*a* pass through the conductive cloth to be received in the locking holes 132*b* of the second conducting part 100*b*. Further, the locking projections 170*a* and 180*a* are of curved forms conforming to their swing tracks. It is therefore possible to reduce load on the conductive cloth when the locking projections 170*a* and 180*a* stick into the conductive cloth.

Also, when the first and second conducting parts 100*a* and 100*b* sandwich the conductive cloth therebetween, the contacting portions 190*a* of the first conducting part 100*a* resiliently contact the conductive cloth to press the conductive cloth onto the second conducting part 100*b*. Therefore, the first and second conducting parts 100*a* and 100*b* have an improved retaining force and stable contact resistance values with respect to the conductive cloth. In addition, the conductive cloth as sandwiched between the first and second conducting parts 100*a* and 100*b* is in abutment with the projections 191*a* of the contacting portions 190*a* and the projections 131*a* and 131*b* of the first and second conducting parts 100*a* and 100*b*. This abutment increases the contact area with the conductive cloth and thereby stabilizes the contact resistance value of the first and second conducting parts 100*a* and 100*b* with respect to the conductive cloth. Further, the spring constant of the contacting portions 190*a* can be changed by changing the shape of the contacting portions 190*a*. Therefore, the connector, if under vibration or shock, is unlikely to produce resonance with the contacting portions 190*a*.

When the first and second conducting parts 100*a* and 100*b* sandwich the conductive cloth therebetween, the abutments 250*a* and 260*a* of the first body 200*a* abut the abutments 250*b* and 260*b* of the second body 200*b*, leaving a the predetermined clearance between the first and second conducting parts 100*a* and 100*b*. Therefore, even when an external force is applied to the connector, the predetermined clearance between the first and second conducting parts 100*a* and 100*b* can be ensured, ensuring a predetermined connected state between the first and second conducting parts 100*a* and 100*b* and the conductive cloth.

The first body 200*a* and the second body 200*b* are molded articles of insulating resin having the same shape, so that the first and second bodies 200*a* and 200*b* can be made with the same die. This results in a reduced cost of the connector. In addition, the second recess 281*b* in the second body 200*b* functions as an accommodating recess to accommodates the holding portion 130*d* of the cable connecting part 100*d*. On the other hand, the first recess 281 a of the first body 200 in the open position receives the first arm 270*b* of the second body 200*b* to avoid interference between the first body 200*a* and the second body 200*b*. In this way, the recesses of the second arms of the first body 200*a* and the second body 200*b*, having the same shape, serves double duty as an interference avoiding mechanism and accommodating recess.

Embodiment 2

Figure 4A:
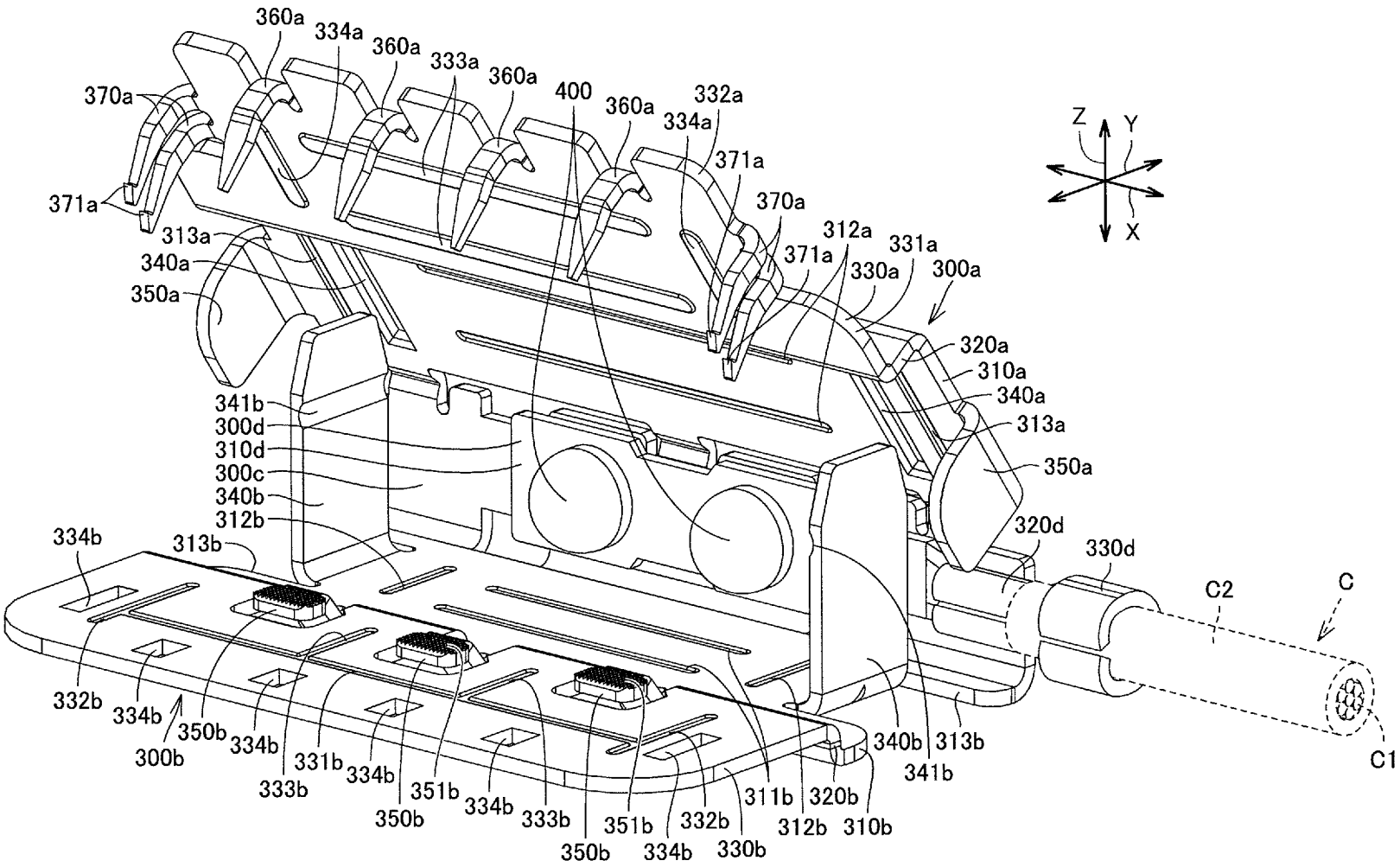
FIG. 4A is a front, top, and right side perspective view of a connector according to Embodiment 2 of the invention, in which a cable is connected to the connector and first and second conducting parts are located in an open position.
Figure 4B:
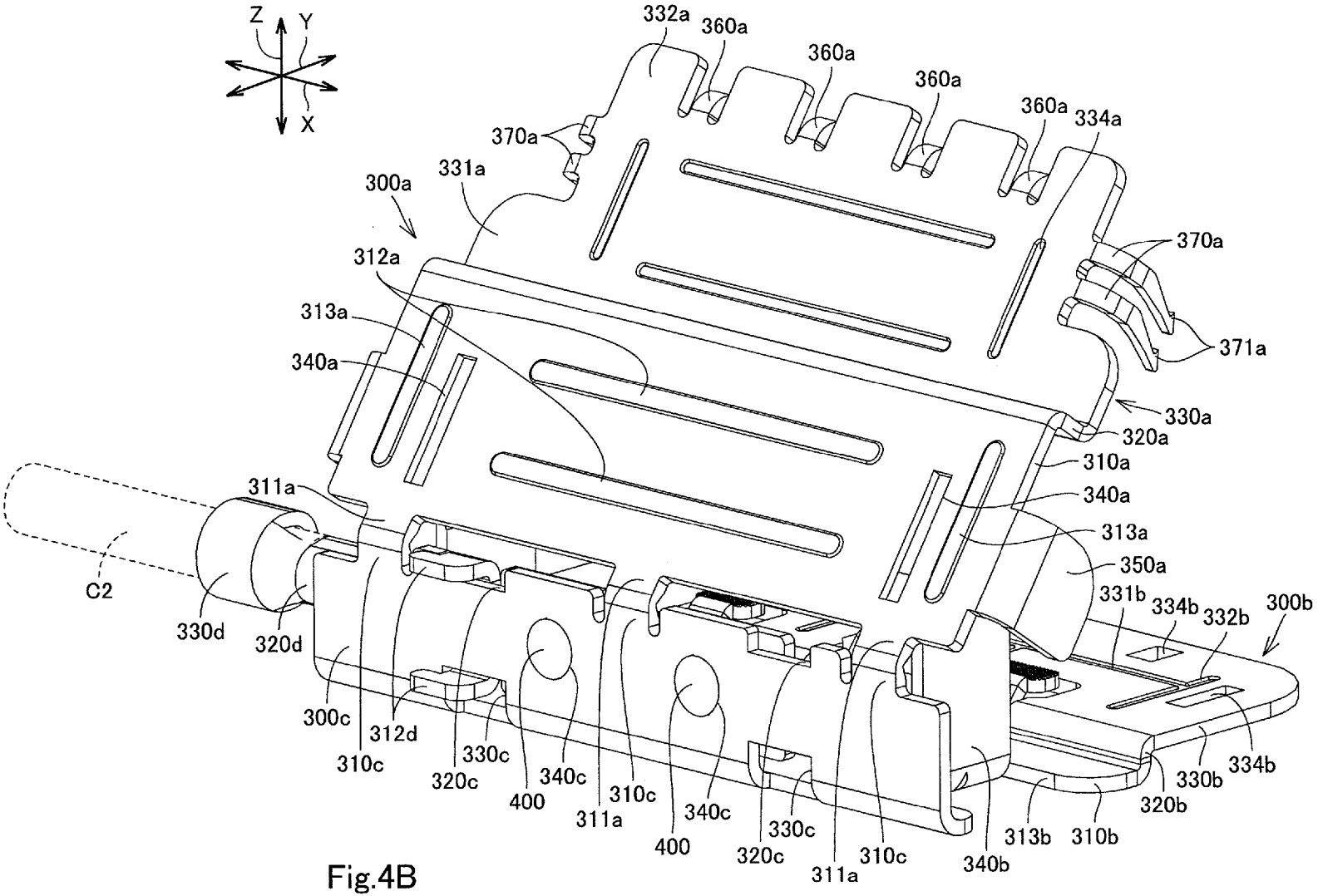
FIG. 4B is a rear, top, and left side perspective view of the connector, in which the cable is connected to the connector and the first and second conducting parts are located in the open position.
Figure 4C:
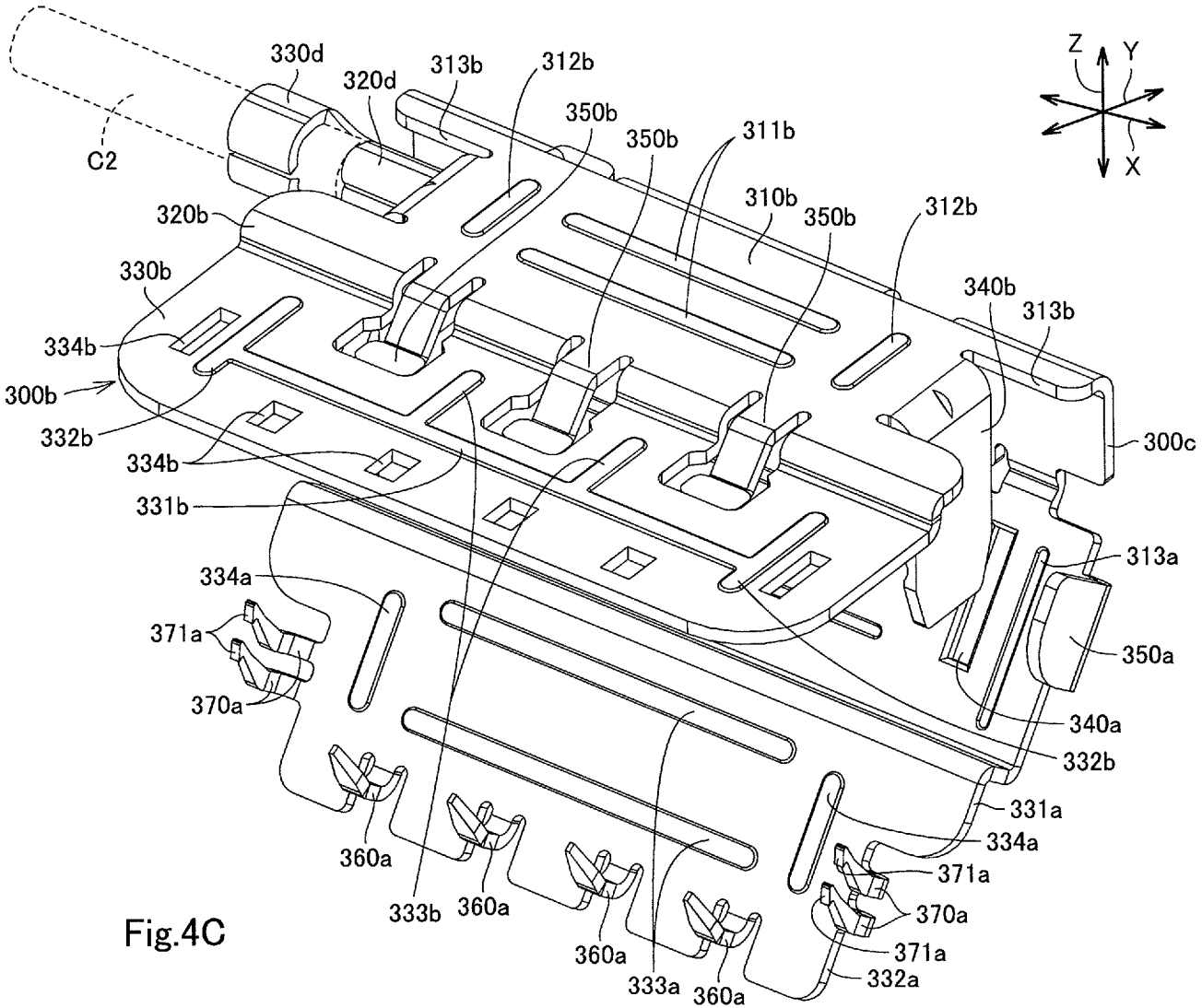
FIG. 4C is a front, bottom, and left side perspective view of the connector, in which the cable is connected to the connector and the first and second conducting parts are located in the open position.
Figure 4D:
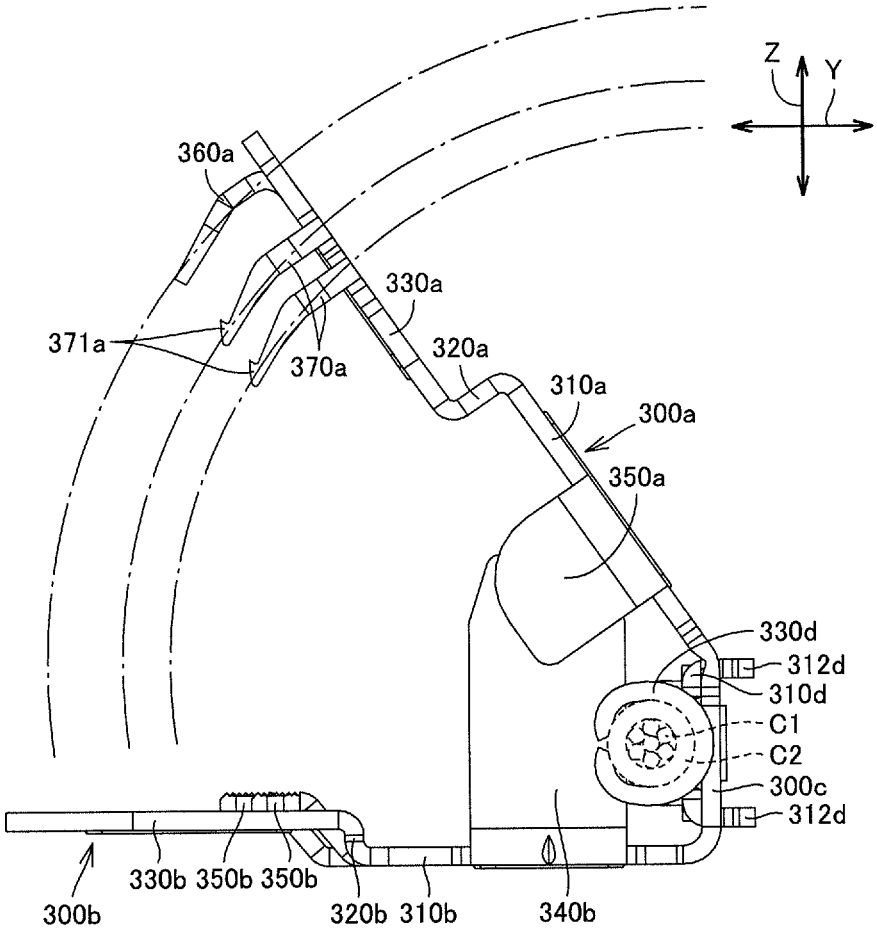
FIG. 4D is a right side view of the connector, in which the cable is connected to the connector and the first and second conducting parts are located in the open position.
Figure 5A:
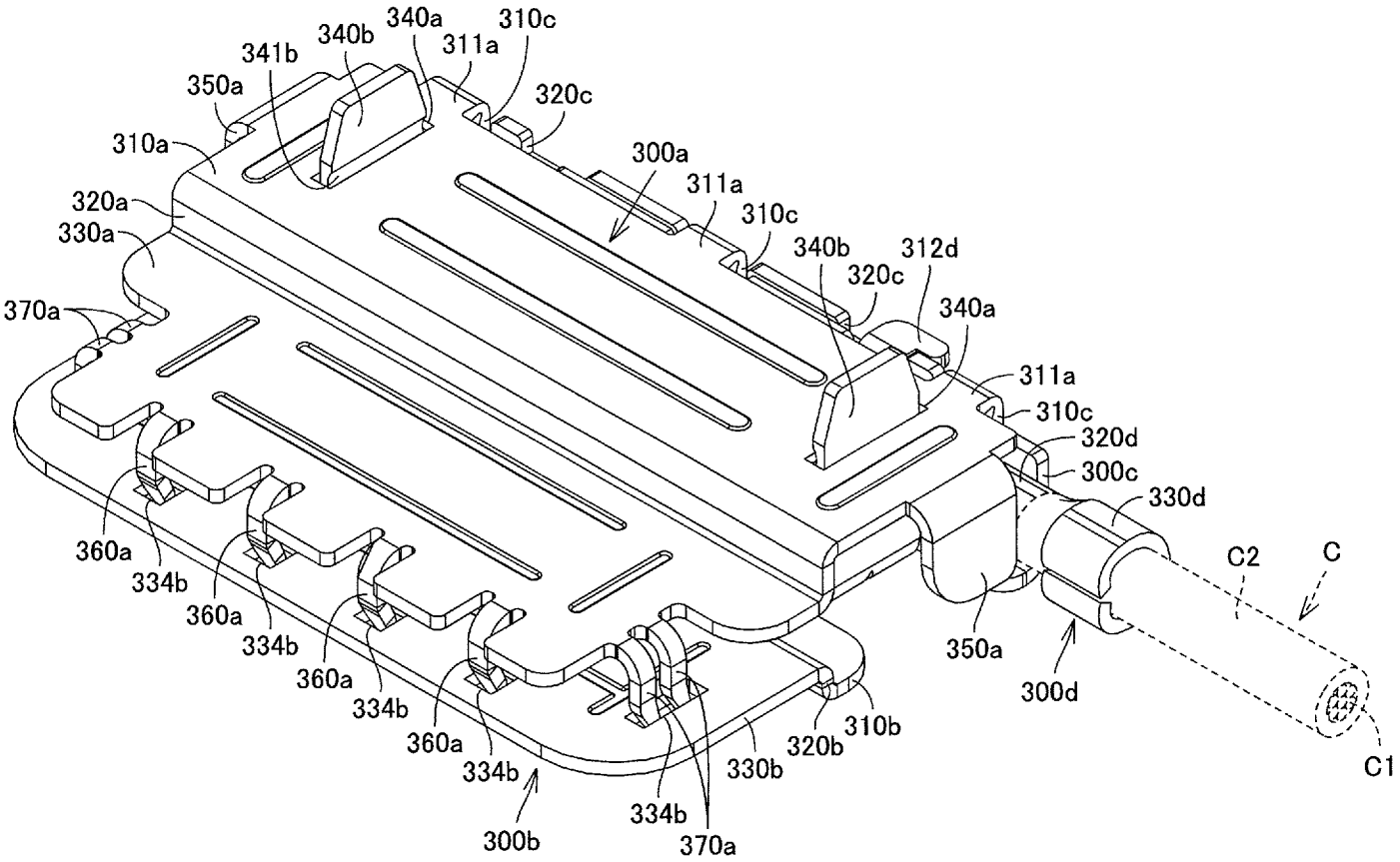
FIG. 5A is a front, top, and right side perspective view of the connector, in which the cable is connected to the connector and the first and second conducting parts are located in a closed position.
Figure 5B:
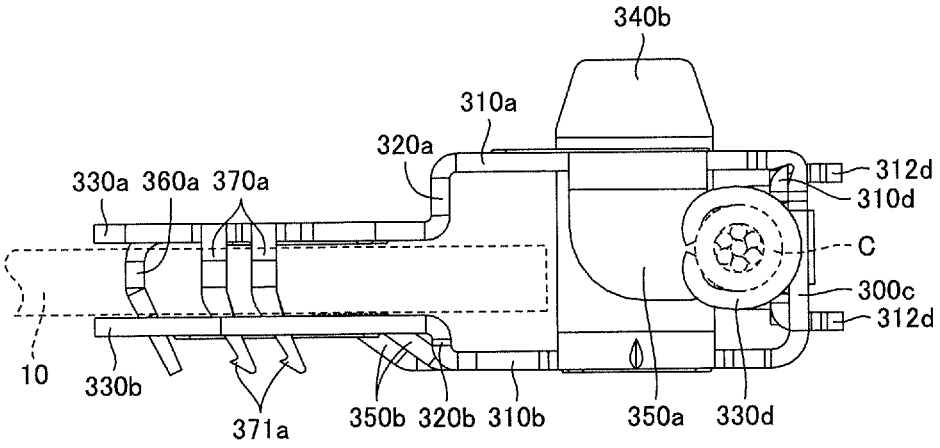
FIG. 5B is a right side view of the connector, in which the cable and a conductive cloth are connected to the connector and the first and second conducting parts are located in the closed position.

Next, a connector according to Embodiment 2 of the invention will be described with reference to FIGS. 4A to 6B. The connector shown in FIGS. 4A to 5B may be used for connection with a flexible conductive cloth 10 (conductor) as shown in FIG. 5B. The connector has a first conducting part 300*a*, a second conducting part 300*b*, a coupling part 300*c*, a cable connecting part 300*d*, and a plurality of rivets 400. These constituents of the connector will be described bellow in detail. FIGS. 4A to 4D show directions X, Y, and Z, wherein X is the length direction of the connector, Y is the front-rear direction of the connector, and Z is the height direction of the connector. The Y direction is perpendicular to the X direction, and the Z direction is perpendicular to the X and Y directions.

As shown in FIGS. 4A to 4D, the first conducting part 300*a*, the second conducting part 300*b*, and the coupling part 300*c* are made of a plate of electrically conductive metal. The second conducting part 300*b* includes a first plate 310*b*, a second plate 320*b*, a third plate 330*b*, a pair of lock pieces 340*b* (constituent of a lock mechanism), and a plurality of contacting portions 350*b*.

The first plate 310*b* is a generally rectangular plate extending in the X direction and to one side in the Y direction. A plurality of first ribs 311*b* and a plurality of second ribs 312*b* are provided on the central area of the upper face (the face facing the first conducting part) of the first plate 310*b*. The first ribs 311*b* and the second ribs 312*b* are formed by pressing portions of the first plate 310*b*. The first ribs 311*b* extend in parallel along the X direction. The second ribs 312*b* are located outside the X direction ends of the first ribs 311*b* and extend in the direction perpendicular to the first ribs 311*b* (i.e. in the Y direction). The first ribs 311*b* and the second ribs 312*b* serve to improve the first plate 310*b* in strength. The X direction ends of the first plate 310*b* are provided with a pair of rectangular cutaways 313*b*. The lock pieces 340*b* are joined to the inner edges of the cutaways 313*b* (the edges in the X direction). The lock pieces 340*b* are located on the inner side of the ends in the X direction (the lengthwise direction) of the first plate 310*b*.

The lock pieces 340*b* are rectangular plates bent upward with respect to the first plate 310*b* (one side in the Z direction). The lock pieces 340*b* have bendable portions 341*b* toward their ends. The bendable portions 341*b* extend in the Y direction. The bendable portions 341*b* have a smaller wall thickness than the portions other than the bendable portions 341*b* (remaining portions) of the lock pieces 340*b*. The lock pieces 340*b* are bendable inward along the bendable portions 341*b*. The lock pieces 340*b* may be bent at portions thereof other than the bendable portions 341*b*.

The second plate 320*b* is a rectangular plate joined to the first plate 310*b* and bent substantially at a right angle to the first plate 310*b* to extend toward the first conducting part 300*a*. The third plate 330*b* is a rectangular plate joined to the second plate 320*b* and extends in the X direction and to the one side in the Y direction (to the front side). The third plate 330*b* is bent substantially at a right angle to the second plate 320*b* so that the first plate 310*b* and the third plate 330*b* do not face each other.

A first rib 331*b*, a plurality of second ribs 332*b*, and a plurality of third ribs 333*b* are provided on the upper face (the face facing the first conducting part) of the third plate 330*b*. The first rib 331*b*, the second ribs 332*b*, and the third ribs 333*b* are formed by pressing portions of the third plate 330*b*. The first rib 331*b* extends in the X direction. The second ribs 332*b* are joined to the X direction ends of the first rib 331*b* and extend in the direction perpendicular to the first rib 331*b* (in the Y direction). The third ribs 333*b* are joined to the intermediate portion in the X direction of the first rib 331*b* and extend in the direction perpendicular to the first rib 331*b* (in the Y direction). The first rib 331*b*, the second ribs 332*b*, and the third ribs 333*b* serve to improve the third plate 330*b* in strength.

The third plate 330*b* is provided with a plurality of locking holes 334*b* in spaced relation to each other. The locking holes 334*b* are rectangular holes passing through the third plate 330*b* in the Z direction, and they are arranged in the positions corresponding to locking projections 360*a* and 370*a* (to be described) of the first conducting part 300*a*. The locking holes 334*b* correspond to the "locking holes" defined in the claims.

The first plate 310*b*, the second plate 320*b*, and the third plate 330*b* include the contacting portions 350*b*. The contacting portions 350*b* are located between the second ribs 332*b* and the third ribs 333*b* and between the third ribs 333*b*. The contacting portions 350*b* are resilient pieces formed by cutting and raising portions of the first plate 310*b*, the second plate 320*b*, and the third plate 330*b* upward. As shown in FIG. 4D, the contacting portions 350*b* are bent stepwise so that their upper faces of the distal portions (the face facing the first conducting part) are located closer to the first conducting part 300*a* than the upper face (the face facing the first conducting part) of the third plate 330*b*. The contacting portions 350*b* resiliently deformable to positions in which the upper faces of the distal portions of the contacting portions 350*b* are flush with the upper face of the third plate 330*b*. The upper faces of the distal portions of the contacting portions 350*b* are each provided with a plurality of projections 351*b*. The projections 351*b* are of quadrangular pyramid shape projecting toward the first conducting part 300*a*.

The first conducting part 300*a* includes a first plate 310*a*, a second plate 320*a*, a third plate 330*a*, a pair of lock holes 340*a* (constituent of the lock mechanism), a pair of movable parts 350*a*, a plurality of locking projections 360*a*, and a plurality of locking projections 370*a*.

The first plate 310*a* is a rectangular plate extending in the X direction and obliquely upward (in a direction between the one side in the Z direction and the one side in the Y direction). As shown in FIG. 4B, the lower end (the end on the other side (the other end) in the Z direction) of the first plate 310*a* is provided with three arms 311*a* in spaced relation to each other in the X direction. The movable parts 350*a* are joined to the X direction ends of the first plate 310*a*. The movable parts 350*a* are rectangular plates bent at right angles to the first plate 310*a* to extend toward the second conducting part 300*b*. The lock holes 340*a* are provided at opposite ends of the first plate 310*a*, more particularly in the positions corresponding to the lock pieces 340*b* of the second conducting part 300*b*. The lock holes 340*a* are rectangular holes passing through the first plate 310*a* and adapted to receive the lock pieces 340*b*. The lock holes 340*a* are located on the inner side of the ends in the X direction (the lengthwise direction) of the first plate 310*a*. Further, a plurality of first ribs 312*a* and a plurality of second ribs 313*a* are provided on the lower face (the face facing the second conducting part) of the first plate 310*a*. The first ribs 312*a* and the second ribs 313*a* are formed by pressing portions of the first plate 310*a*. The first ribs 312*a* are located between the lock holes 340*a* and extend in parallel along the X direction. The second ribs 313*a* are located on the outer sides of the lock holes 340*a* and extend in the direction perpendicular to the first ribs 312*a* (in a direction between the Y direction and the Z direction). The first ribs 312*a* and the second ribs 313*a* serve to improve the first plate 310*a* in strength.

The second plate 320*a* is a rectangular plate joined to the first plate 310*a* and is bent substantially at a right angle to the first plate 310*a* to extend toward the second conducting part 300*b*. The third plate 330*a* is a plate joined to the second plate 320*a* and extends in the X direction and obliquely upward. The third plate 330*a* is bent substantially at a right angle to the second plate 320*a* so that the first plate 310*a* and the third plate 330*a* do not face each other. The third plate 330*a* has a wider portion 331 a and a narrower portion 332*a*. The narrower portion 332*a* is joined to the wider portion 331*a* and has a smaller dimension in the X direction than the wider portion 331*a*. The third plates 330*a* and 330*b* are adapted to sandwich the conductive cloth 10 therebetween when they are in a closed position as described below.

The locking projections 360*a* are of pointed shape and joined to the end of the narrower portion 332*a* of the third plate 330*a*. The locking projections 360*a* can swing in accordance with the turning of the first conducting part 300*a*. As shown in FIG. 4D, the locking projections 360*a* are bent substantially at right angles to the third plate 330*a*, and they are of curved forms conforming to their swing tracks. The swing tracks of the locking projections 360*a* are indicated in dot-dash lines in FIG. 4D. The locking projections 370*a* are of pointed shape and joined to opposite ends in the X direction of the narrower portion 332*a* of the third plate 330*a*. The locking projections 370*a* can swing in accordance with the turning of the first conducting part 300*a*. As shown in FIG. 4D, the locking projections 370*a* are bent substantially at right angles to the third plate 330*a*, and they are of curved forms conforming to their swing tracks. The swing tracks of the locking projections 370*a* are indicated in dot-dash lines in FIG. 4D. The locking projections 370*a* are provided at their distal ends with barbs 371*a*. The locking projections 360*a* and 370*a* are arranged in the positions corresponding to the locking holes 334*b* in the second conducting part 300*b* (that is, in the central area and at the opposite ends of the first conducting part 300*a*). The locking projections 360*a* and 370*a* pass through the conductive cloth 10 and are received in the locking holes 334*b* when the first and second conducting parts 300*a* and 300*b* are located in the closed position. The barbs 371*a* can be locked in the locking holes 334*b*.

Further, a plurality of first ribs 333*a* and a plurality of second ribs 334*a* are provided on the lower face (the face facing the second conducting part) of the third plate 330*a*. The first ribs 333*a* and the second ribs 334*a* are formed by pressing portions of the third plate 330*a*. The first ribs 333*a* extend in parallel along the X direction. The second ribs 334*a* are located on the outer sides of the ends in the X direction of the first ribs 333*a* and extend in the direction perpendicular to the first ribs 333*a*. The first ribs 333*a* and the second ribs 334*a* serve to improve the third plate 330*a* in strength.

The coupling part 300*c* is a rectangular plate to couple the ends of the first and second conducting parts 300*a* and 300*b* such that the first and second conducting parts 300*a* and 300*b* are turnable from the closed position to an open position. The coupling part 300*c* is joined to the rear end (the other end in the Y direction) of the first plate 310*b* of the second conducting part 300*b*, and it is bent substantially at a right angle to the first plate 310*b*. At the upper end (one end in the Z direction) of the coupling part 300*c*, there are three arms 310*c* in the positions corresponding to the arms 311*a* of the first conducting part 300*a*. The arms 310*c* extend upward (to the one side in the Z direction) and are coupled to the arms 311*a* of the first conducting part 300*a*. The boundaries between the arms 310*c* and 311*a* are thin-walled. The boundaries serve as pivots on which the first and second conducting parts 300*a* and 300*b* turn (open and close) from the closed position to the open position. As shown in FIGS. 5A and 5B, the first and second conducting parts 300*a* and 300*b* in the closed position face each other substantially in parallel and securely sandwich the conductive cloth 10 therebetween. As shown in FIGS. 4A to 4D, the first and second conducting parts 100*a* and 100*b* in the open position are located away from each other, allowing the conductive cloth 10 to be released from therebetween.

The upper end of the coupling part 300*c* is provided with engaging recesses 320*c*, each being located between adjacent two of the arms 310*c* as shown in FIG. 4B. The lower end of the coupling part 300*c* is provided with two locking holes 330*c* in the positions corresponding to the two engaging recesses 320*c*. The middle portion of the coupling part 300*c* is provided with two attaching holes 340*c* in spaced relation to each other in the X direction. The attaching holes 340*c* pass through the thickness of the coupling part 300*c*.

Figure 6A:
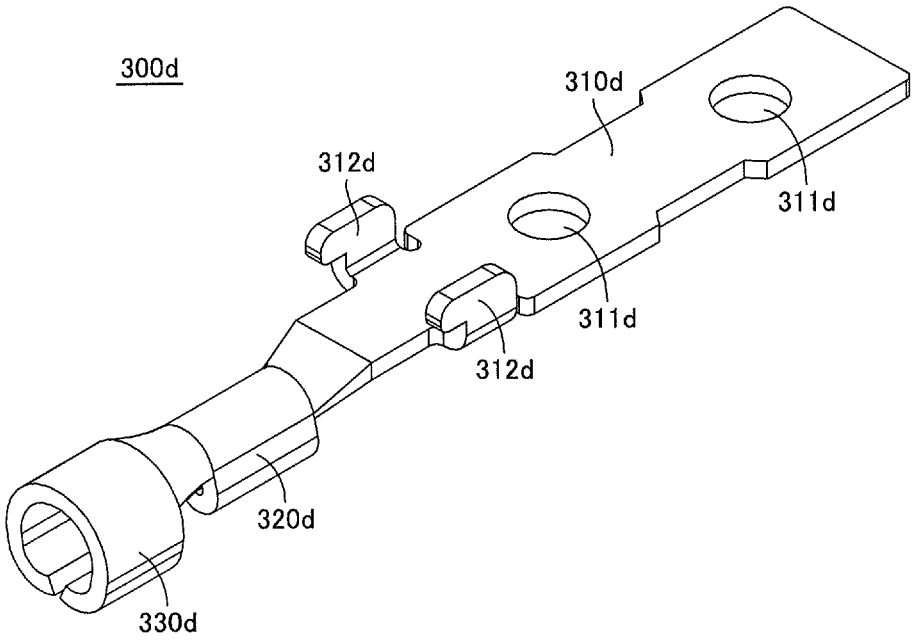
FIG. 6A is a rear, top, and right side perspective view of a cable connecting part of the connector.
Figure 6B:
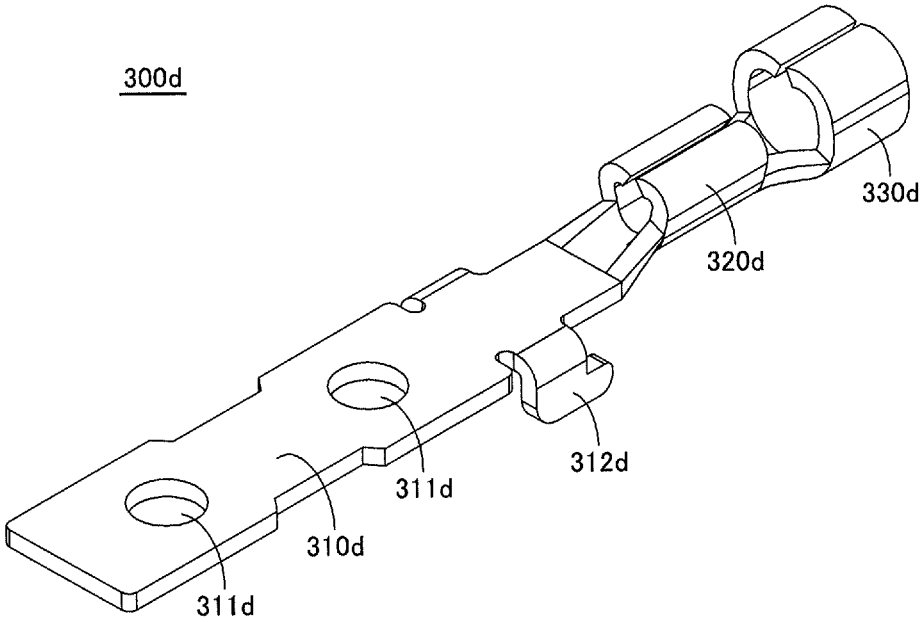
FIG. 6B is a front, bottom, and left side perspective view of the cable connecting part of the connector.

The cable connecting part 300*d* is a plate of electrically conductive metal fixed to the coupling part 300*c*. As shown in FIGS. 6A and 6B, the cable connecting part 300*d* has a fixed portion 310*d*, a connecting portion 320*d*, and a holding portion 330*d*. The fixed portion 310*d* is a rectangular plate of a smaller dimension in the X direction than the coupling part 300*c*. The fixed portion 310*d* is provided with two attaching holes 311*d* passing through the thickness of the fixed portion 310*d*. The attaching holes 311*d* are located in such positions as to communicate with the attaching holes 340*c* of the coupling part 300*c*. The attaching holes 311*d* and 340*c* receive the rivets 400, which fixes the fixed portion 310*d* to the front face of the coupling part 300*c*. In FIGS. 4A and 4B, the heads of the rivets 400 point inward (to the cable connecting part 300*d* side), but they may be point outward (to the coupling part 300*c* side).

The upper and lower ends (opposite ends in the Z direction) of the fixed portion 310*d* are provided with a pair of hooks 312*d*. The hooks 312*d* are generally L-shaped plates. The hooks 312*d* each include a basal portion, which is bent substantially at a right angle to the fixed portion 310*d*, and a distal portion, which extends to the connecting portion 320*d* side. One of the hooks 312*d* is engaged in one of the two engaging recesses 320*c* of the coupling part 300*c*, and the other hook 312*d* is engaged in one of the two locking holes 330*c* of the coupling part 300*c*.

The connecting portion 320*d* is a generally C-shaped plate joined to the fixed portion 310*d*, and it is of inside diameter slightly smaller than the outside diameter of a core C1 of a cable C. The connecting portion 320*d* is adapted to hold the core C1 of the cable C. The holding portion 330*d* is a generally C-shaped plate joined to the connecting portion 320*d*, and it is of inside diameter slightly smaller than the outside diameter of an insulative protective cover C2 that covers the core C1 of the cable C. The holding portion 330*d* is adapted to hold the protective cover C2 of the cable C.

Described in detail below are steps to assemble the connector configured as described above and to connect the connector to the connecting cable C. The first step is to prepare the cable connecting part 300*d* formed by pressing an electrically conductive metal plate. The cable connecting part 300*d* now have the connecting portion 320*d* and the holding portion 330*d* in planar form. The next step is to prepare the cable C, in which one end in the length direction of the protective cover C2 is peeled off to expose the core C1 from the protective cover C2. The exposed core C1 and the protective cover C2 are brought closer to the connecting portion 320*d* and the holding portion 330*d*, respectively. The connecting portion 320*d* is then bent in a generally C-shape and fixedly connected to the core C1. Likewise, the holding portion 330*d* is bent in a generally C-shape and fixed to the protective cover C2.

The next step is to prepare the first conducting part 300*a*, the second conducting part 300*b*, and the coupling part 300*c*, which are formed by pressing an electrically conductive metal plate. The hooks 312*d* of the fixed portion 310*d* of the cable connecting part 300*d* are brought into engagement with one of the engaging recesses 320*c* and one of the locking holes 330*c* of the coupling part 300*c*, thereby bringing the fixed portion 310*d* into contact with the front face of the coupling part 300*c*. In this state, the rivets 400 are inserted into the attaching holes 311*d* of the fixed portion 310*d* and then into the attaching holes 340*c* of the coupling part 300*c*, so that the fixed portion 310*d* of the cable connecting part 300*d* is fixed to the coupling part 300*c*. The core C1 of cable C is thus electrically connected to the first and second conducting parts 300*a* and 300*b* via the coupling part 100*c*.

Described below are the steps to connect the conductive cloth 10 to the connector assembled as described above. First, the first and second conducting parts 100*a* and 100*b* are brought into the open position. Then, the conductive cloth 10 is inserted between the first and second conducting parts 300*a* and 300*b*. The next step is to turn the first and second conducting parts 300*a* and 300*b* from the open position to the closed position, using the boundaries between the arms 310*c* and the arms 311*a* as pivots. Specifically, the first conducting part 300*a* (moving part) is turned so as to approach the second conducting part 300*b* (fixed part). The first and second conducting parts 300*a* and 300*b* are thus brought closer each other and securely sandwich the conductive cloth 10 therebetween.

When the first and second conducting parts 300*a* and 300*b* turn from the open position to the closed position, the locking projections 360*a* of the first conducting part 300*a* swing in accordance with the turning of the first conducting part 300*a* to stick into the conductive cloth 10. The locking projections 360*a* are then received into the locking holes 334*b* of the second conducting part 300*b*. The locking projections 370*a* swing in accordance with the turning of the first conducting part 300*a* to stick into the conductive cloth 10. The locking projections 370*a* are then engagingly received into the locking holes 334*b* of the second conducting part 300*b*. The contacting portions 350*b* of the second conducting part 300*b* are pressed by the conductive cloth 10 and resiliently deformed to the positions in which the upper face of the distal portions of the contacting portions 350*b* are flush with the upper face of the third plate 330*b*. As a result, the projections 351*b* on the distal portions of the contacting portions 350*b* resiliently contact the conductive cloth 10. The movable parts 350*a* swing in accordance with the turning of the first conducting part 300*a* to approach the connecting portion 320*d* of the cable connecting part 300*d*. The movable parts 350*a* then abut the connecting portion 320*d* of the cable connecting part 300*d* (see FIG. 5A). As a result, the connecting portion 320*d* is securely sandwiched between the movable parts 350*a* and the coupling part 300*c*. The lock pieces 340*b* of the second conducting part 300*b* are received into the lock holes 340*a* of the first conducting part 300*a*.

Thereafter, the lock pieces 340*b* are bent inward along the bendable portions 341*b*. The lock pieces 340*b* then abut the first conducting part 300*a* (specifically, the first plate 310*a*). Consequently, the first and second conducting parts 300*a* and 300*b* are locked while sandwiching the conductive cloth 10 therebetween.

In the connector as described above, the first and second conducting parts 300*a* and 300*b* are connected to the conductive cloth 10 by sandwiching the conductive cloth 10 therebetween to make the locking projections 360*a* and 370*a* pass through the conductive cloth 10. It is therefore easy to change the connection position s of the first and second conducting parts 300*a* and 300*b* with respect to the conductive cloth 10. In addition, as the locking projections 360*a* and 370*a* pass through the conductive cloth 10, there is no need to make large holes for attaching hooks in the conductive cloth 10. Therefore, there is no damaging of the electrodes in the conductive cloth 10 due to such hole-making, thereby improving the connection stability of the connector with respect to the conductive cloth 10.

Further, the connector has an improved tension strength with respect to the conductive cloth 10 because the locking projections 360*a* and 370*a* pass through the conductive cloth 10 to be received in the locking holes 334*b* of the second conducting part 300*b*. Further, the hooks 312*d* of the cable connecting part 300*d* are engaged with the associated engaging recess 320*c* and the associated locking hole 330*c* of the coupling part 300*c*. The connecting portion 320*d* of the cable connecting part 300*d* is sandwiched between the movable parts 350*a* and the coupling part 300*c*. These arrangements improving the fixing strength of the cable connecting part 300*d* with respect to the coupling part 300*c*, making the cable connecting part 300*d* more resistant to external load, and thereby improve the prying resistance of the cable connecting part 300*d*. The above arrangements also improve the tension strength of the cable C connected to the cable connecting part 300*d*. Also, as the hooks 312*d* of the cable connecting part 300*d* engaged into the engaging recess 320*c* and the locking hole 330*c* of the coupling part 300*c*, it is possible to reduce a load on the rivets 400, i.e. the part joining the cable connecting part 300*d* and the coupling part 300*c*.

Further, the locking projections 360*a* and 370*a* are of curved forms conforming to their swing tracks. It is therefore possible to reduce load on the conductive cloth 10 when the locking projections 360*a* and 370*a* stick into the conductive cloth 10.

Also, when the first and second conducting parts 300*a* and 300*b* sandwich the conductive cloth 10 therebetween (when they are in the closed position), the contacting portions 350*b* of the second conducting part 300*b* resiliently contact the conductive cloth 10 to press the conductive cloth 10 onto the first conducting part 300*a*. Therefore, the first and second conducting parts 300*a* and 300*b* have an improved retaining force and stable contact resistance values with respect to the conductive cloth 10. In addition, it is possible to increase the contact area with respect to the conductive cloth 10 because the conductive cloth 10 as sandwiched between the first and second conducting parts 300*a* and 300*b* (in the closed position) is in abutment with the projections 351*b* of the contacting portions 350*b*. This abutment increases the contact area with respect to the conductor 10 and thereby stabilize the contact resistance value of the first and second conducting parts 300*a* and 300*b* with respect to the conductive cloth 10. Further, the spring constant of the contacting portions 350*b* can be changed by changing the shape of the contacting portions 350*b*. Therefore, the connector under vibration or shock is less likely to produce resonance with the contacting portions 350*b*.

Further, when the first and second conducting parts 300*a* and 300*b* are located in the closed position, the lock pieces 340*b* of the second conducting part 300*b* (i.e. the fixed part) are received in the lock holes 340*a* of the first conducting part 300*a* (i.e. the moving part). It is therefore possible to lock the first and second conducting parts 300*a* and 300*b* as sandwiching the conductive cloth 10 therebetween, simply by bending the lock pieces 340*b* into abutment with the first conducting part 300*a*. It is also possible to change the distance between the first and second conducting parts 300*a* and 300*b* and to change the pressure of the contacting portions 350*b* to the conductive cloth 10, simply by changing the bending positions of the lock pieces 340*b* according to the thickness dimension of the conductive cloth 10 which may greatly vary. Therefore, the connector can provide an appropriate contact pressure to the conductive cloth 10 according to the thickness dimension of the conductive cloth 10.

Still further, the lock pieces 340*b* are located on the inner sides of the ends in the X direction of the first plate 310*b*. The lock holes 340*a* are located on the inner sides of the ends in the X direction of the first plate 310*a*. The lock pieces 340*b* and the lock holes 340*a* are thus configured and provided in the second and first conducting part 300*b* and 300*a*, respectively, without substantially increasing the outer dimensions of the connector.

It should be noted that the connector of the invention is not limited to the above embodiments and may be modified in any manner within the scope of claims as detailed below.

In Embodiment 1, the first conducting part 100*a* includes the first plate 110*a*, the second plate 120*a*, the third plate 130*a*, the pair of first locking pieces 140*a*, the pair of second locking pieces 150*a*, the pair of third locking pieces 160*a* (constituent of the lock mechanism), the locking projections 170*a* and 180*a*, and the contacting portions 190*a*, while the second conducting part 100*b* includes the first plate 110*b*, the second plate 120*b*, the third plate 130*b*, the pair of first locking pieces 140*b*, the pair of second locking pieces 150*b*, and the pair of third locking pieces 160*b* (constituent of the lock mechanism). In Embodiment 2, the first conducting part 300*a* includes the first plate 310*a*, the second plate 320*a*, the third plate 330*a*, the pair of lock holes 340*a* (constituent of the lock mechanism), the pair of movable parts 350*a*, and the locking projections 360*a* and 370*a*, while the second conducting part 300*b* includes the first plate 310*b*, the second plate 320*b*, the third plate 330*b*, the pair of lock pieces 340*b* (constituent of the lock mechanism), and the contacting portions 350*b*. However, the first and second conducting parts of the invention may be modified in any manner as long as they are electrically conductive and adapted to sandwich a flexible conductor therebetween and at least one of the first and second conducting parts includes a locking projection. In addition, the first and second conducting parts are not limited to be press-formed and may also be formed e.g. by casting (e.g., aluminum die cast).

In Embodiment 1, the first conducting part 100*a* is fixed to the first body 200*a* by bringing the first and second locking pieces 140*a* and 150*a* into engagement with the locking holes 221*a* and the locking holes 211*a*, respectively, of the first body 200*a*. However, the first conducting part of the invention may be fixed to the first body by any other known means. For instance, the first conducting part may be fixed to the first body by providing locking pieces on the first body to be locked in locking holes provided in the first conducting part. The first conducting part of the invention may also be fixed to the first body by insert molding or outsert molding. The first conducting part of the invention may also be fixed to the first body with an adhesive. The fixing means of the second conducting part to the second body may also be modified in a similar manner to the fixing means of the first conducting part to the first body.

In Embodiment 1, the first conducting part 100*a* includes the locking projections 170*a* and 180*a*. In Embodiment 2, the first conducting part 300*a* includes the locking projections 360*a* and 370*a*. However, the locking projection of the invention maybe modified in any manner if it is provided in at least one of the first and second conducting parts, adapted to swing in accordance with the turning of the one of the conducting parts, adapted to pass through a conductor, and of a curved form conforming to a swing track thereof. The barbs 181*a* of the locking projections 180*a* and the barbs 371*a* of the locking projections 370*a* may be omitted. The barbs can be provided on the locking projections 170*a* and/or 360*a*. Each locking projection may be provided with a plurality of barbs.

In Embodiment 1, the second conducting part 100*b* is provided with the locking holes 132*b* adapted to receive the locking projections 170*a* and 180*a*. In Embodiment 2, the second conducting part 300*b* is provided with the locking holes 334*b* adapted to receive the locking projections 360*a* and 370*a*. However, the locking holes may be omitted. In this case, the locking projections are provided in the first conducting part so as not to abut the second conducting part when the first and second conducting parts are located in the closed position. In addition, the locking holes may be replaced with engaging recesses. If the locking projections are provided in both the first and second conducting parts, the locking holes or recesses may be provided in both the first and second conducting parts. If the locking projection is provided in the second conducting part, the locking hole or recess may be provided in the first conducting part. The locking hole/holes or recess/recesses may be omitted even if the locking projections are provided in both the first and second conducting parts or if the locking projection is provided in the second conducting part. In this case, the first and second conducting parts include locking projections adapted to not abut the second or first conducting parts, or the second conducting part includes a locking projection adapted to not abut the first conducting part. Locking hole/holes and locking recess/recesses may coexist in the first and/or second conducting parts.

In Embodiment 1, the first and second conducting parts 100*a* and 100*b* include the projections 131*a*, 191*a*, and 131*b*. In Embodiment 2, the projections 351*b* are provided on the distal portions of the contacting portions 350*b* of the second conducting part 300*b*. However, the projections may be omitted. Alternatively, only in one of the first and second conducting parts includes a projection or projections. In Embodiments 1 and 2, the projections are of quadrangular pyramid shapes, but projections may be of any other shapes (various convex shapes such as conical shape, polygonal pyramid shape, or cut-and-raised teeth as used in a grater). The first and second conducting parts may have a recess or recesses in place of the projections. The recess/recesses may be provided only in one of the first and second conducting parts. The recess/recesses may be of quadrangular pyramid shape. If the first and second conducting parts have a recess or recesses, the inner face/faces of the recess/recesses contact the conductor, increasing contact areas of the first and/or second conducting parts with the conductor and stabilizing their contact resistance values with respect to the conductor. The first and second conducting parts may have both the projection/projections and the recess/recesses.

In Embodiment 2, the first conducting part 300*a* includes the first and second ribs 312*a* and 313*a* and the first and second ribs 333*a* and 334*a*, while the second conducting part 300*b* includes the first and second ribs 311*b* and 312*b* and the first, second, and third ribs 331*b*, 332*b*, and 333*b*. However, any of these ribs may be omitted. The ribs may be provided in one of the first and second conducting parts. In addition, the ribs may be replaced with a concave-convex face provided in at least one of the first and second conducting parts. The concave-convex face may be diamond cut-shaped, for example. The concave-convex face can also improve the strength of the at least one of the first and second conducting parts. The ribs may or may not be formed by pressing portions of the first or second conducting parts.

In Embodiment 1, the first conducting part 100*a* includes the contacting portions 190*a*. In Embodiment 2, the second conducting part 300*b* includes the contacting portions 350*b*. However, the contacting portions may be omitted. Alternatively, the contacting portions may be provided in at least one of the first and second conducting parts. In Embodiments 1 and 2, the contacting portions are resilient pieces formed by cutting and raising portions of an electrically conductive metal plate. However, the contacting portions may be modified to any configuration adapted to resiliently contact a conductor sandwiched by the first and second conducting parts. For instance, the contacting portions may be resilient pieces separately provided from the first and second conducting parts, or resilient bodies having electrical conductivity, such as coil springs and conductive rubbers. The projections provided on the distal portions of the contacting portions may be omitted.

In Embodiment 1, the coupling part 100*c* is configured such that the thin-walled boundaries between the arms 110*c* and 111*a* serves as pivots on which the first and second conducting parts 100*a* and 100*b* turn from the closed position to the open position. In Embodiment 2, the coupling part 300*c* is configured such that the thin-walled boundaries between the arms 310*c* and 311*a* serves as pivots on which the first and second conducting parts 300*a* and 300*b* turn from the closed position to the open position. However, the coupling part of the invention may be modified as long as it is adapted to couple the ends of the first and second conducting parts in a turnable manner from the closed position, in which the first and second conducting parts can sandwich the flexible conductor therebetween, to the open position, in which the first and second conducting parts can release the conductor; or as long as the coupling part is adapted to couple the ends of the first and second bodies in a turnable manner from the closed position, in which the first and second conducting parts can sandwich the flexible conductor therebetween, to the open position, in which the first and second conducting parts can release the conductor. For instance, the coupling part may include a hinge mechanism to couple the ends of the first and second, conducting parts or the ends of the first and second bodies in a turnable manner from the closed position to the open position. In addition, the coupling part of the configurations similar to those in Embodiments 1 and 2 may be used to couple the ends of the first and second bodies.

Figure 8A:
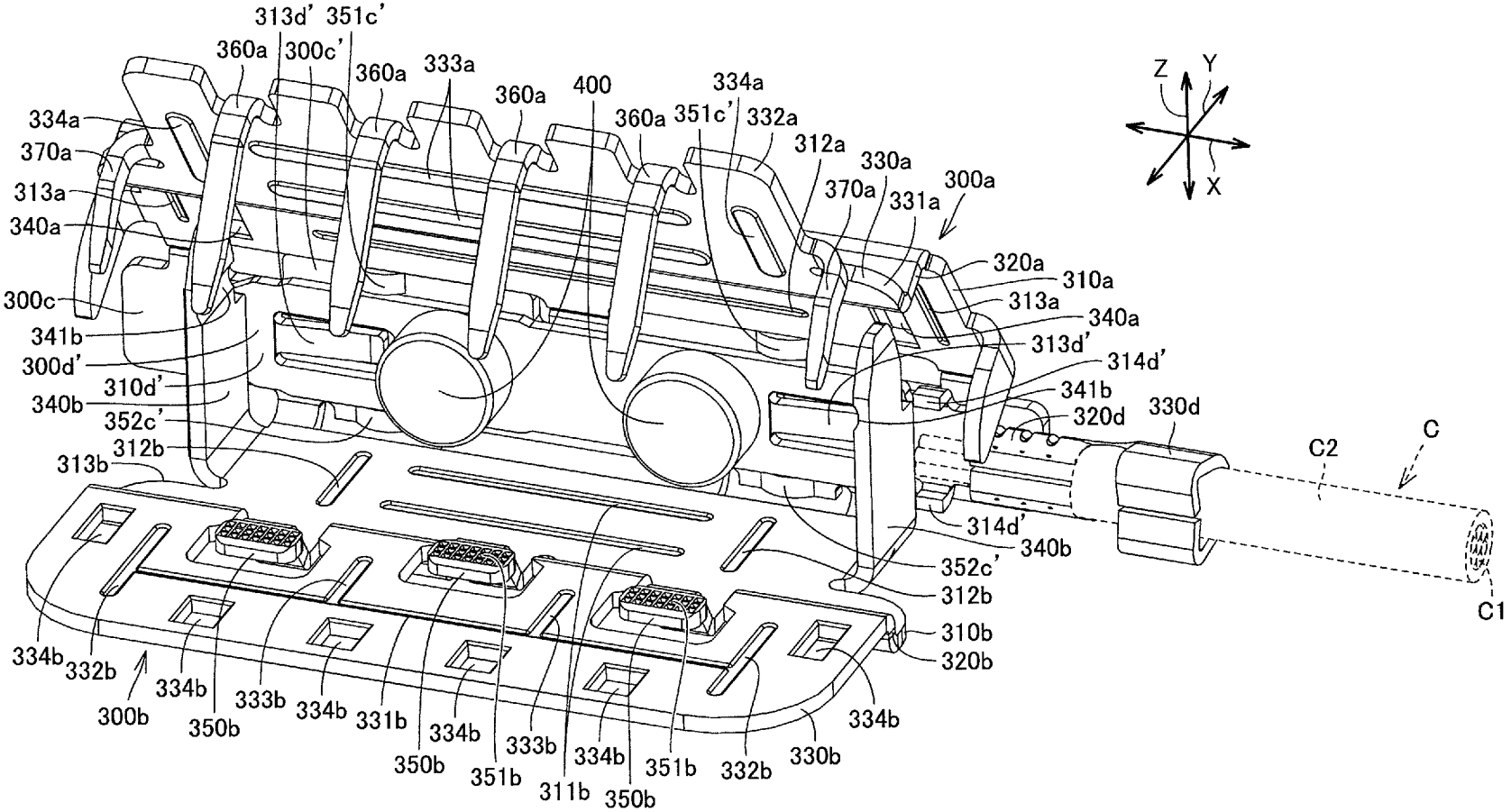
FIG. 8A is a front, top, and right side perspective view of a second modification of the connector, in which the cable is connected to the connector and the first and second conducting parts are located in the open position.
Figure 8B:
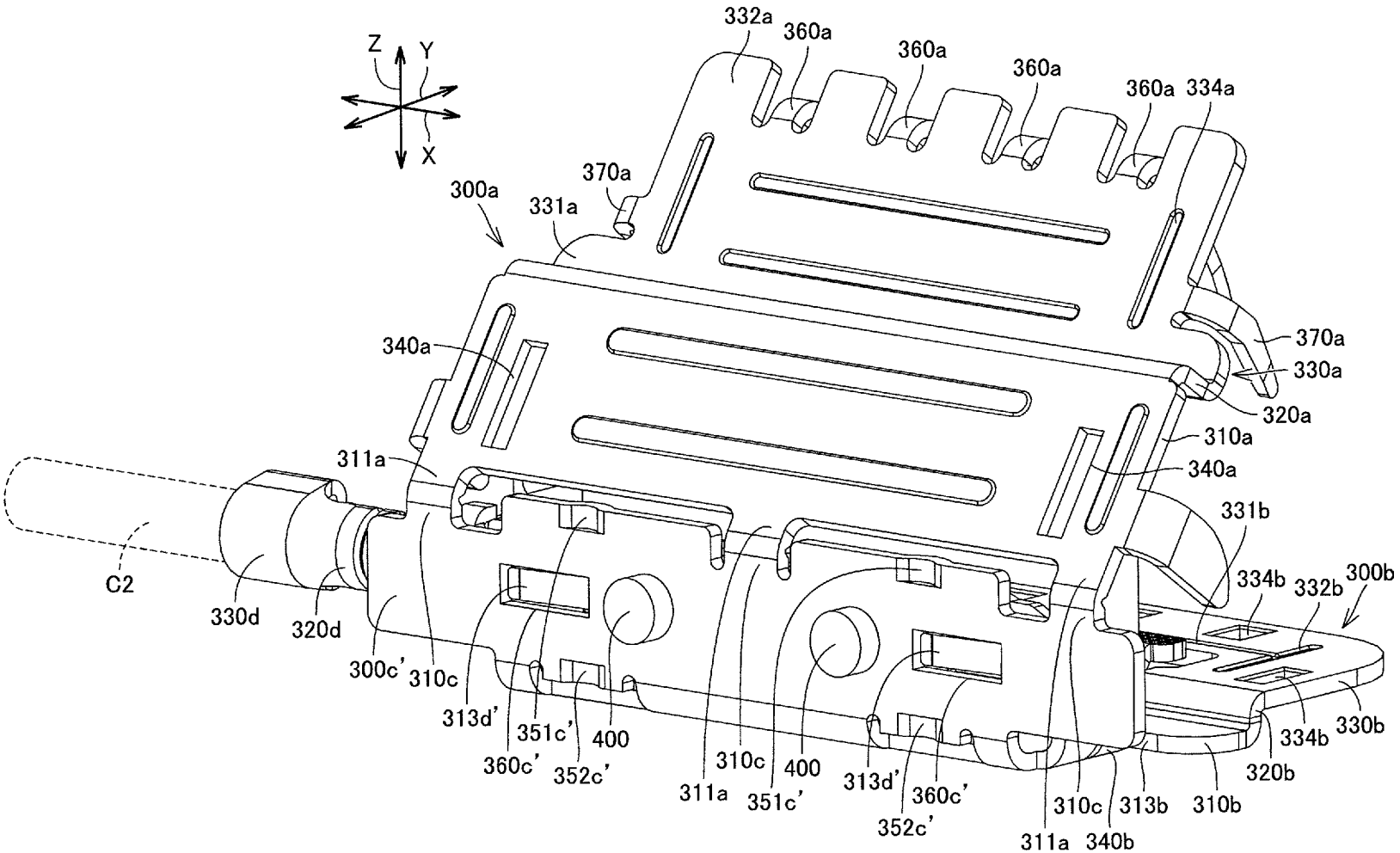
FIG. 8B is a rear, top, and left side perspective view of the connector, in which the cable is connected to the connector and the first and second conducting parts are located in the open position.

Alternatively, the coupling part may be configured like a coupling part 300*c*' as illustrated in FIGS. 8A and 8B. Particularly, the upper end (one end in the Z direction) of the coupling part 300*c*' is provided with a plurality of first guide projections 351*c*', and the lower end (the other end in the Z direction) of the coupling part 300*c*' is provided with a plurality of second guide projections 352*c*'. The first and second guide projections 351*c*' and 352*c*' project to one end side in the Y direction. The first guide projections 351*c*' and the second guide projections 352*c*' are spaced from each other in the Z direction. The distance between the first guide projections 351*c*' and the second guide projections 352*c*' is set to be slightly larger than the dimension in the Z direction of a fixed portion 310*d*' of a cable connecting part 300*d*'. The fixed portion 310*d*' is inserted between the first guide projections 351*c*' and the second guide projections 352*c*' to be guided to a fixing position with respect to the coupling part 300*c*'. The fixing position is the position in which attaching holes (not shown) in the coupling part 300*c*' are aligned with and in communication with attaching holes (not shown) in the fixed portion 310*d*'. However, the fixing position may be set at any position. The rivets 400 are attached into the aligned attaching holes of the coupling part 300*c*' and the fixed portion 310*d*'. The first guide projections 351*c*' and the second guide projections 352*c*' may be provided on the coupling parts of Embodiments 1 and/or 2. If the cable connecting part is fixed to the rear face of the coupling part, the first and second guide projections 351*c*' and 352*c*' should project to the other end side in the Y direction.

In Embodiment 1, the lock mechanism to maintain the first and second conducting parts 100*a* and 100*b* in the closed position includes the third locking pieces 160*a* with the lock lugs 161*a* of the first conducting part 100*a*, and the third locking pieces 160*b* with the lock lugs 161*b* of the second conducting part 100*b*. In Embodiment 2, the lock mechanism to maintain the first and second conducting parts 300*a* and 300*b* in the closed position includes the pair of lock holes 340*a* in the first conducting part 300*a* and the pair of lock pieces 340*b* of the second conducting part 300*b*. However, the lock mechanism may be omitted. Alternatively, the lock mechanism may be modified to any configuration adapted to lock the first conducting part to the second conducting part in the state where the first and second conducting parts sandwich the conductor therebetween (closed position).

For instance, the lock mechanism may be configured that the second conducting part 100*b* includes lock lugs to be locked in lock holes of the first conducting part 100*a*. Alternatively, the lock pieces 340*b* of Embodiment 2 may be formed without the bendable portions 341*b*. Alternatively, the lock pieces 340*b* may each have a plurality of bendable portions 341*b*. In this case, the lock pieces 340*b* may be bent along each of the bendable portions.

Figure 7A:
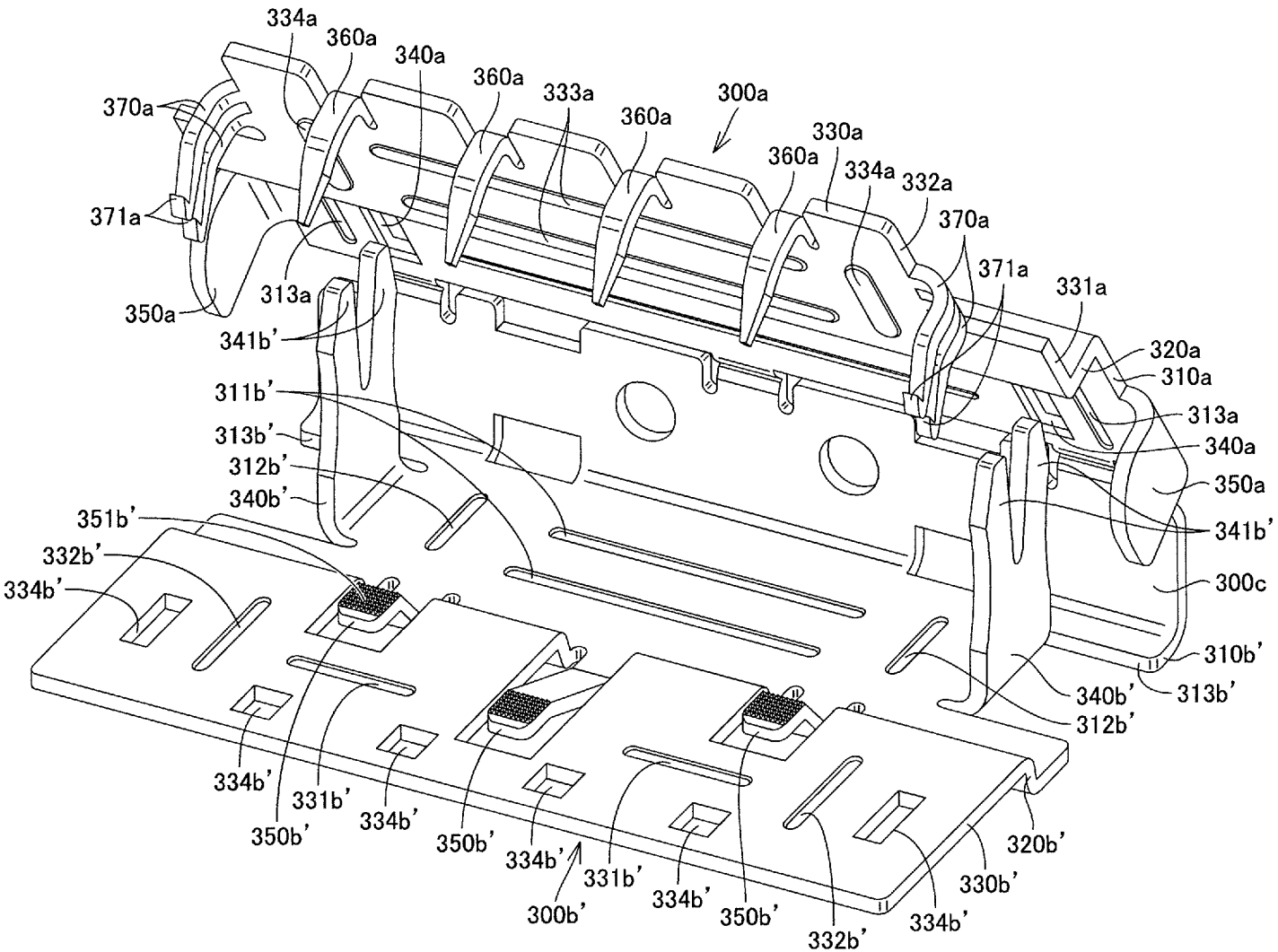
FIG. 7A is a front, top, and right side perspective view of a first modification of the connector, in which the cable connecting part is removed and the first and second conducting parts are located in the open position.
Figure 7B:
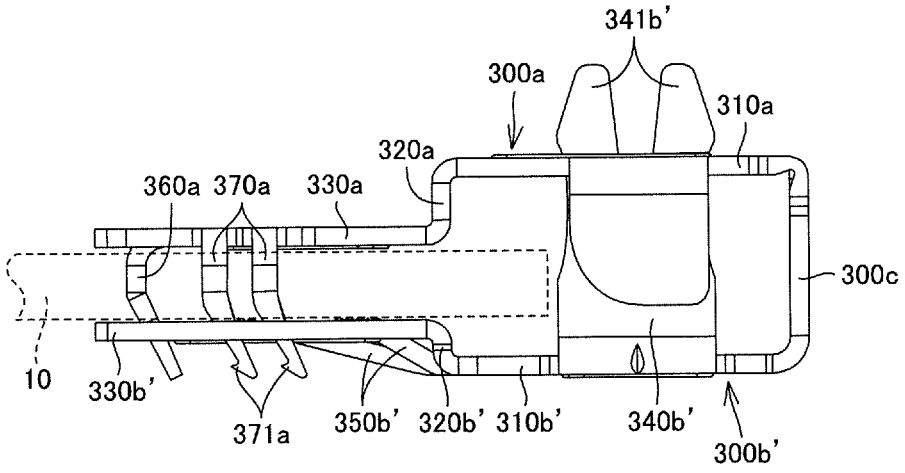
FIG. 7B is a right side view of the modified connector, in which the conductive cloth is connected to the connector and the first and second conducting parts are located in the closed position.

The lock mechanism may be configured as shown in FIGS. 7A and 7B. Particularly, a second conducting part 300*b*' includes lock pieces 340*b*' at the edges of cutaways 313*b*' in a first plate 310*b*', and the lock pieces 340*b*' each bifurcate into two distal portions 341*b*' and 341*b*' (they are each of V shape). The distal portions 341*b*' and 341*b*' of the lock pieces 340*b*' are adapted to be inserted into respective lock holes 340*a* in the first conducting part 300*a* to be plastically deformed in directions away from each other and engaged with the edges of the lock holes 340*a*. This configuration makes it easy to lock the first and second conducting parts 300*a* and 300*b*' as sandwiching the conductive cloth 10 therebetween, simply by plastically deforming the distal portions 341*b*' and 341*b*' of the lock pieces 340*b*' in the directions away from each other and engaging them with the edges of the lock holes 340*a*. It is also possible to change the distance between the first and second conducting parts 300*a* and 300*b*' and to change the pressure of the contacting portions 350*b*' to the conductive cloth 10, simply by changing the height position of the engagement of the distal portions 341*b*' and 341*b*' of the lock pieces 340*b*' with respect to the edges of the lock holes 340*a* in accordance with the thickness dimension, which may greatly vary, of the conductive cloth 10. Therefore, the connector can provide an appropriate contact pressure to the conductive cloth 10 in accordance with the thickness dimension of the conductive cloth 10. The second conducting part 300*b*' may be configured, except for the above description, substantially the same as the second conducting part 300*b* of Embodiment 2.

FIGS. 7A and 7B also illustrate first ribs 311*b*' of the first plate of the second conducting part, second ribs 312*b*' of the first plate of the second conducting part, a second plate 320*b*' of the second conducting part, a third plate 330*b*' of the second conducting part, first ribs 331*b*' of the third plate of the second conducting part, second ribs 332*b*' of the third plate of the second conducting part, locking holes 334*b*' of the second conducting part, and contacting portions 350*b*' of the second conducting part. The cable connecting part 300*d* is not illustrated in FIGS. 7A and 7B. The lock pieces may each be trifurcated into distal ends (may each be of W-shaped). Also in this case, the outer two of the distal ends may be plastically deformed to be engaged with the edges of the lock holes in a similar manner to the bifurcated lock pieces.

In Embodiments 1 and 2, the cable connecting part is fixed to the coupling part. However, the cable connecting part may be omitted. The cable connecting part may be fixed to the front face or the rear face of the coupling part. In addition, the cable connecting part may consist of the connecting portion only. In other words, the holding portion may be omitted. The connecting portion may be modified in any manner as long as it is connected to at least one of the first and second conducting parts and connectable to a cable. Particularly, the connecting portion may be fixed or integrally provided to the first and/or second conducting parts. Alternatively, the connecting portion may be integrally provided in the coupling part if it is electrically conductive. In Embodiment 2, the hooks 312*d* of the cable connecting part 300*d* are engaged in the associated engaging recess 320*c* and the associated locking hole 330*c* of the coupling part 300*c*. However, the hooks, the engaging recess, and the locking hole may be omitted. Alternatively, the hooks may be engaged in the engaging recesses only or in the locking holes only of the coupling part. Alternatively, the hooks and the engaging recesses (or the locking holes) may be provided in both the cable connecting part and the coupling part of Embodiment 1. The hooks may be provided in the coupling part, and the engaging recesses (or the locking holes) may be provided in the cable connecting part.

FIGS. 8A and 8B illustrates a cable connecting part 300*d*' including a fixed portion 310*d*' provided with a pair of first stops 313*d*' and a pair of second stops 314*d*' in place of the hooks 312*d*. The first stops 313*d*' (engaging portions) are resilient pieces extending in the X direction, formed by cutting out portions of the central area of the fixed portion 310*d*' and bent to the coupling part 300*c*' side. The first stops 313*d*' are spaced from each other in the X direction. The central area of the coupling part 300*c*' is formed with locking holes 360*c*' in spaced relation to each other in the X direction. The locking holes 360*c*' are of shape slightly larger than the outer shapes of the first stops 313*d*'. The second stops 314*d*' are generally L-shaped plates provided at the upper and lower ends (opposite ends in the Z direction) of the fixed portion 310*d*' and are bent to the lock pieces 340*b* side of the second conducting part 300*b*. When the fixed portion 310*d*' is inserted between the coupling part 300*c*' and the lock pieces 340*b* and is then guided by the first guide projections 351*c*' and the second guide projections 352*c*' to reach the fixing position (i.e., when the cable connecting part 300*d*' is located in the fixing position), the first stops 313*d*' are engaged in the locking holes 360*c*', and the second stops 314*d*' abut the lock piece 340*b*. The fixed portion 310*d*' is thus positioned and held in the fixing position with respect to the coupling part 300*c*'. In this state, the fixed portion 310*d*' is fixed to the coupling part 300*c*' with the rivets 400. It should be noted the cable connecting part may include the first stops 313*d*' only or the second stops 314*d*' only. Also, the first guide projections 351*c*' and the second guide projections 352*c*' may be omitted, in which case the cable connecting part 300*d*' can be positioned in the fixing position with respect to the coupling part 300*c*' by bringing the first stops 313*d*' into engagement with the locking holes 360*c*' and/or by bringing the second stops 314*d*' into abutment with the lock pieces 340*b*. Conversely, the first stops 313*d*' and the second stops 314*d*' may be omitted, in which case the first guide projections 351*c*' and the second guide projections 352*c*' may guide the fixed portion 310*d*' to the fixing position. The second guide projections 352*c*' may be adapted to abut the respective lock pieces 340*b*. The first stops 313*d*' may be provided in the coupling part, while the locking holes 360*c*' may be provided in the cable connecting part. The locking holes 360*c*' may be replaced with engaging recesses.

In Embodiment 2, the first plate 310*a* includes the movable parts 350*a*. However, any of the movable parts may be omitted. The movable parts may be any movable part provided in at least one of the first and second conducting parts and adapted to approach and abut the connecting portion of the cable connecting part so as to sandwich the connecting portion between the movable parts and the coupling part when the first and second conducting parts turn from the open position to the closed position. The movable parts may be provided in at least one of the first and second conducting parts of Embodiment 1.

In Embodiment 1, the first and second bodies 200*a* and 200*b* are fixed to the first and second conducting parts 100*a* and 100*b*, respectively. However, the first and second bodies may be omitted. In addition, in Embodiment 1, the first and second bodies 200*a* and 200*b* are blocks of the same shape and made of insulating resin, but the invention is not limited to this. That is, the first and second bodies may have different shapes and are not required to have insulation properties. Further, the first and second bodies may be made of a material other than insulating resin but may still have insulation properties. For instance, the first and second bodies may be made of a metal and an insulating film coating the outer surface of the metal.

In Embodiment 1, the first body 200*a* includes the abutments 250*a* and 260*a*, and the second body 200*b* includes the abutments 250*b* and 260*b*. However, any of the abutments may be omitted. The abutments may be any abutment provided in at least one of the first and second bodies and adapted to abut the other of the first and second bodies when the first and second conducting parts sandwich the conductor therebetween, thereby creating a predetermined clearance between the first and second conducting parts.

In Embodiment 1, the first arm 270*a* is joined to the rear end of the abutment 250*a* and extends in the width direction of the first body 200*a* (in the second direction). However, the first arm may be omitted. Alternatively, the first arm may be modified in any manner as long as it is provided at the first end in a first direction of the first body and extends in a second direction perpendicular to the first direction. The first arm 270*b* of the second body 200*b* may also be omitted or modified in a similar manner to the first arm 270*a*.

In Embodiment 1, the second arm 280*a* is joined to the rear end of the base 210*a*, the wall 240*a*, and the abutment 260*a* and extends in the width direction of the first body 200*a* (in the second direction). However, the second arm may be omitted. In addition, the second arm may be modified in any manner as long as it is provided at the second end in the first direction of the first body, extends in the second direction perpendicular to the first direction, and has a recess. The second arm 280*b* of the second body 200*b* may be omitted or modified in a similar manner to the second arm 280*a*.

The recesses in the second arms of the first and second bodies of the same shape may be any recesses one of which can receive the first arm of the second body when the first and second conducting parts are located in the open position, and another of which can be used as an accommodating recess to accommodates at least one of the connecting portion, the holding portion, and the cable. If the second arms include the recesses only, it preferable that the recesses pass through the second arms in the first direction.

Embodiments 1 and 2 and the above modifications have been described for describing examples of the material, shape, size, number, and arrangement of the respective constituents of the connectors, which may be modified in any manner as long as they can provide similar functions. Embodiments 1 and 2 are concerned only with a conductive cloth as an example of the flexible conductor. However, the conductor may be an electric carpet with electrodes on its surface, a conductive sheet, a locating tape, etc.

REFERENCE SIGNS LIST

100*a*: First conducting part
110*a*: First plate
120*a*: Second plate
130*a*: Third plate
131*a*: Projection
140*a*: First locking piece
150*a*: Second locking piece
160*a*: Third locking piece (constituent of lock mechanism)
161*a*: Lock lug
170*a*: Locking projection
180*a*: Locking projection
181*a*: Barb
190*a*: Contacting portion
191*a*: Projection
100*b*: Second conducting part
110*b*: First plate
120*b*: Second plate
130*b*: Third plate
131*b*: Projection
132*b*: Locking hole
133*b*: Hole
140*b*: First locking piece
150*b*: Second locking piece
160*b*: Third locking piece (constituent of lock mechanism)
161*b*: Lock hole
100*c*: Coupling part
100*d*: Cable connecting part
110*d*: Fixed portion
120*d*: Connecting portion
130*d*: Holding portion
200*a*: First body
210*a*: Base
220*a*: Stand
230*a*: Wall
240*a*: Wall
250*a*: Abutment
260*a*: Abutment
270*a*: First arm
280*a*: Second arm
281*a*: First recess (recess in the second arm)
282*a*: Second recess
200*b*: Second body
210*b*: Base
220*b*: Stand
230*b*: Wall
240*b*: Wall
250*b*: Abutment
260*b*: Abutment
270*b*: First arm
280*b*: Second arm
281*b*: First recess (recess in the second arm)
282*b*: Second recess
300*a*: First conducting part
310*a*: First plate
311*a*: Arm
312*a*: First rib
313*a*: Second rib
320*a*: Second plate
330*a*: Third plate
331*a*: Wider portion
332*a*: Narrower portion
333*a*: First rib
334*a*: Second rib
340*a*: Lock hole
350*a*: Movable part
360*a*: Locking projection
370*a*: Locking projection
371*a*: Barb
300*b*: Second conducting part
310*b*: First plate
311*b*: First rib
312*b*: Second rib
320*b*: Second plate
330*b*: Third plate
331*b*: First rib
332*b*: Second rib
333*b*: Third rib
334*b*: Locking hole
340*b*: Lock piece
350*b*: Contacting portion
351*b*: Projection
300*c*: Coupling part
320*c*: Engaging recess
330*c*: Locking hole
300*d*: Cable connecting part
310*d*: Fixing portion
312*d*: Hook
320*d*: Connecting portion
330*d*: Holding portion
C: Cable
10: Conductive cloth

The invention claimed is:

1. A connector comprising:

first and second conducting parts; and a coupling part to couple ends of the first and second conducting parts to allow the first and second conducting parts to turn from a closed position, in which the first and second conducting parts sandwich therebetween a conductor having flexibility, to an open position, in which the first and second conducting parts release the conductor, wherein at least one of the first and second conducting parts includes a locking projection, the locking projection being configured to swing in accordance with the turning of the one of the conducting parts and pass through the conductor, and wherein the locking projection is of a curved form conforming to a swing track of the locking projection.

2. The connector according to claim 1, further comprising:

a first body with insulation properties, configured to be fixed to the first conducting part and cover the first conducting part; and a second body with insulation properties, configured to be fixed to the second conducting part and cover the second conducting part.

3. The connector according to claim 1, wherein at least the other one of the first and second conducting parts includes a locking hole or recess to receive the locking projection.

4. The connector according to claim 1, wherein at least one of the first and second conducting parts includes a contacting portion configured to resiliently contact the conductor as sandwiched by the first and second conducting parts.

5. The connector according to claim 4, wherein the one of the conducting parts is made of an electrically conductive metal plate, wherein the contacting portion is a resilient piece formed by cutting and raising a portion of the metal plate.

6. The connector according to claim 2, wherein one of the first and second bodies includes an abutment to create a predetermined clearance between the first and second conducting parts by abutting the other one of the first and second bodies with the first and second conducting parts sandwiching the conductor therebetween.

7. The connector according to claim 2, further comprising a connecting portion connected to at least one of the first and second conducting parts and connectable to a cable.

8. The connector according to claim 7, further comprising a holding portion configured to hold the cable.

9. The connector according to claim 7, wherein the coupling part is electrically conductive, and the connector further comprises a cable connecting part configured to be fixed to the coupling part, the cable connecting part including the connecting portion.

10. The connector according to claim 9, further comprising a movable part provided in at least one of the first and second conducting parts, wherein the movable part is configured to approach and abut the connecting portion of the cable connecting part when the first and second conducting parts turn from the open position to the closed position, and abutment of the movable part on the connecting portion causes the connecting portion of the cable connecting part to be sandwiched between the movable part and the coupling part.

11. The connector according to claim 9, wherein at least one of the cable connecting part and the coupling part includes a hook, and the other of the cable connecting part and the coupling part includes a locking hole or recess engageable with the hook.

12. The connector according to claim 9, wherein at least one of the cable connecting part and the coupling part includes a first stop, the other of the cable connecting part and the coupling part includes a locking hole or recess engageable with the first stop.

13. The connector according to claim 9, further comprising:

a lock mechanism configured to lock the first conducting part to the second conducting part with the first and second conducting parts sandwiching the conductor therebetween, the lock mechanism including:

a lock hole or recess provided in one of the first and second conducting parts, and a lock piece provided in the other one of the first and second conducting parts and configured to be received in the lock hole or recess, and wherein the cable connecting part includes a second stop to abut the lock piece.

14. The connector according to claim 9, wherein the coupling part includes first and second guide projections in spaced relation to each other, the first and second guide projections being configured to receive the cable connecting part therebetween to guide the cable connecting part to a fixing position with respect to the coupling part.

15. The connector according to claim 7, wherein the first and second bodies have a same shape and are made of an insulating resin, the first and second bodies each include:

a first end in a first direction, a second end on the opposite side of the first end in the first direction, a first arm being provided at the first end and extending in a second direction perpendicular to the first direction, and a second arm being provided at the second end and extending in the second direction, the second arm is provided with a recess, and the recess in the second arm of the second body is configured to accommodate at least one of the connecting portion, the holding portion, and the cable.

16. The connector according to claim 1, wherein at least one of the first and second conducting parts includes at least one of a projection and a recess contactable with the conductor.

17. The connector according to claim 16, wherein the at least one of the projection and the recess is of a quadrangular pyramid shape.

18. The connector according to claim 1, wherein the locking projection comprises a plurality of locking projections provided at the center and opposite ends of the first conducting part.

19. The connector according to claim 1, wherein the locking projection is provided with a barb.

20. The connector according to claim 1, wherein at least one of the first and second conducting parts include a rib or a concave-convex face.

21. The connector according to claim 1, further comprising a lock mechanism configured to lock the first conducting part to the second conducting part with the first and second conducting parts sandwiching the conductor therebetween.

22. The connector according to claim 21, wherein the lock mechanism includes:

a lock lug provided in one of the first and second conducting parts, and a lock hole or recess provided in the other one of the first and second conducting parts to lock the lock lug therein with the first and second conducting parts sandwiching the conductor therebetween.

23. The connector according to claim 21, wherein the lock mechanism includes:

a lock hole or recess provided in one of the first and second conducting parts, and a lock piece provided in the other one of the first and second conducting parts and received in the lock hole or recess, the lock piece being bendable.

24. The connector according to claim 23, wherein the lock piece includes a bendable portion and a remaining portion excluding the bendable portion, the bendable portion having a smaller wall thickness than the remaining portion.

25. The connector according to claim 23, wherein the lock hole or recess is disposed inward of lengthwise ends of the one of the first and second conducting parts, the lock piece is disposed inward of lengthwise ends of the other one of the first and second conducting parts.

26. The connector according to claim 21, wherein the lock mechanism includes:

a lock hole provided in one of the first and second conducting parts, and a lock piece provided in the other one of the first and second conducting parts to be inserted into the lock hole, and the lock piece bifurcates or trifurcates into distal portions that are plastically deformable in directions away from each other and engageable with an edge of the lock hole.

27. The connector according to claim 26, wherein the lock hole is disposed inward of lengthwise ends of the one of the first and second conducting parts, wherein the lock piece is disposed inward of lengthwise ends of the other one of the first and second conducting parts.

28. A connector comprising:

first and second conducting parts;

a first body fixed to the first conducting part;

a second body fixed to the second conducting part; and a coupling part to couple ends of the first and second bodies to allow the first and second conducting parts to turn from a closed position, in which the first and second conducting parts sandwich therebetween a conductor having flexibility, to an open position, in which the first and second conducting parts release the conductor, wherein at least one of the first and second conducting parts includes a locking projection, the locking projection being configured to swing in accordance with the turning of the one of the conducting parts and pass through the conductor, and wherein the locking projection is of a curved form conforming to a swing track of the locking projection.

* * * * *